US008211605B2

(12) United States Patent
Yamada et al.

(10) Patent No.: US 8,211,605 B2
(45) Date of Patent: Jul. 3, 2012

(54) TONER, DEVELOPER, TONER CONTAINER, PROCESS CARTRIDGE, IMAGE FORMING METHOD, AND IMAGE FORMING APPARATUS

(75) Inventors: Hiroshi Yamada, Numazu (JP); Satoshi Mochizuki, Numazu (JP); Fumihiro Sasaki, Fuji (JP); Yasuo Asahina, Numazu (JP); Hisashi Nakajima, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 1039 days.

(21) Appl. No.: 12/050,502

(22) Filed: Mar. 18, 2008

(65) Prior Publication Data

US 2008/0233498 A1 Sep. 25, 2008

(30) Foreign Application Priority Data

Mar. 19, 2007 (JP) ..... 2007-071281

(51) Int. Cl.
*G03G 9/08* (2006.01)

(52) U.S. Cl. ..... 430/108.11; 430/108.6; 430/108.7; 430/108.3; 430/109.4; 430/108.1; 430/123.5

(58) Field of Classification Search ..... 430/108.1, 430/108.7, 108.11, 108.6, 109.4, 108.3, 123.5
See application file for complete search history.

(56) References Cited

U.S. PATENT DOCUMENTS

| | | | |
|---|---|---|---|
| 4,841,331 | A | 6/1989 | Nakayama et al. |
| 4,908,290 | A | 3/1990 | Watanabe et al. |
| 4,945,022 | A | 7/1990 | Nakayama et al. |
| 4,980,258 | A | 12/1990 | Aoki et al. |
| 5,061,588 | A | 10/1991 | Fushimi et al. |
| 5,344,732 | A | 9/1994 | Chiba et al. |
| 5,403,690 | A | 4/1995 | Kuramoto et al. |
| 5,554,478 | A | 9/1996 | Kuramoto et al. |
| 5,612,766 | A | 3/1997 | Iida et al. |
| 5,652,079 | A | 7/1997 | Mochizuki et al. |
| 5,659,860 | A | 8/1997 | Sasaki et al. |
| 5,771,426 | A | 6/1998 | Oka et al. |
| 5,840,456 | A | 11/1998 | Tomita et al. |
| 6,074,794 | A | 6/2000 | Fushimi et al. |
| RE37,197 | E | 5/2001 | Iida et al. |
| 6,303,258 | B1 | 10/2001 | Katoh et al. |
| 6,356,729 | B1 | 3/2002 | Sasaki et al. |
| 6,363,229 | B1 | 3/2002 | Shiraishi et al. |
| 6,403,275 | B1 | 6/2002 | Kuramoto et al. |
| 6,406,826 | B1 | 6/2002 | Suzuki et al. |
| 6,468,706 | B2 | 10/2002 | Matsuda et al. |
| 6,500,595 | B1 | 12/2002 | Mochizuki et al. |
| 6,544,704 | B1 | 4/2003 | Matsuda et al. |
| 6,593,048 | B2 | 7/2003 | Sasaki et al. |
| 6,667,141 | B2 | 12/2003 | Iwamoto et al. |
| 6,699,632 | B2 | 3/2004 | Higuchi et al. |
| 6,756,175 | B2 | 6/2004 | Yamada et al. |
| 6,757,507 | B2 | 6/2004 | Mochizuki et al. |
| 6,770,411 | B2 | 8/2004 | Masuda et al. |
| 6,787,280 | B2 | 9/2004 | Yamashita et al. |
| 6,811,944 | B2 | 11/2004 | Higuchi et al. |
| 6,813,461 | B2 | 11/2004 | Higuchi et al. |
| 6,818,369 | B2 | 11/2004 | Sugiura et al. |
| 6,828,075 | B2 | 12/2004 | Suzuki et al. |
| 6,835,517 | B2 | 12/2004 | Kondo et al. |
| 6,846,604 | B2 | 1/2005 | Emoto et al. |
| 6,849,369 | B2 | 2/2005 | Yagi et al. |
| 6,852,462 | B2 | 2/2005 | Emoto et al. |
| 6,856,774 | B2 | 2/2005 | Sampe et al. |
| 6,856,781 | B2 | 2/2005 | Matsuda et al. |
| 6,861,191 | B2 | 3/2005 | Mochizuki et al. |
| 6,873,814 | B2 | 3/2005 | Sasaki et al. |
| 6,902,857 | B2 | 6/2005 | Yagi et al. |
| 6,902,858 | B2 | 6/2005 | Mochizuki et al. |
| 6,911,289 | B2 | 6/2005 | Higuchi et al. |
| 6,924,073 | B2 | 8/2005 | Higuchi et al. |
| 6,936,390 | B2 | 8/2005 | Nanya et al. |
| 6,946,229 | B2 | 9/2005 | Suzuki et al. |
| 6,947,692 | B2 | 9/2005 | Kondo et al. |
| 7,024,140 | B2 | 4/2006 | Masuda et al. |
| 7,029,816 | B2 | 4/2006 | Sasaki et al. |
| 7,056,636 | B2 | 6/2006 | Tomita et al. |
| 7,056,638 | B1 | 6/2006 | Tomita et al. |
| 7,083,890 | B2 | 8/2006 | Emoto et al. |
| 7,129,013 | B2 | 10/2006 | Higuchi et al. |
| 7,157,199 | B2 | 1/2007 | Emoto et al. |
| 7,157,201 | B2 | 1/2007 | Tomita et al. |
| 7,163,773 | B2 | 1/2007 | Sugiura et al. |
| 7,166,403 | B2 | 1/2007 | Ichikawa et al. |

(Continued)

FOREIGN PATENT DOCUMENTS

| | | |
|---|---|---|
| JP | 5-57288 | 3/1993 |
| JP | 5-66600 | 3/1993 |
| JP | 2506522 | 4/1996 |
| JP | 8-211655 | 8/1996 |
| JP | 10-20552 | 1/1998 |
| JP | 2748419 | 2/1998 |
| JP | 11-7156 | 1/1999 |
| JP | 3063269 | 5/2000 |
| JP | 2003-515795 | 5/2003 |
| JP | 2003-202708 | 7/2003 |
| JP | 2003-238819 | 8/2003 |
| JP | 3502993 | 12/2003 |
| JP | 3577390 | 7/2004 |
| JP | 2004-309718 | 11/2004 |
| JP | 2005-49858 | 2/2005 |
| JP | 2006-500605 | 1/2006 |
| JP | 2006-503313 | 1/2006 |

(Continued)

OTHER PUBLICATIONS

English language machine translation of JP 2003-238819 (Aug. 2003).*

English language machine translation of JP 2004-309718 (Nov. 2004).*

*Primary Examiner* — Christopher Rodee

(74) *Attorney, Agent, or Firm* — Oblon, Spivak, McClelland, Maier & Neustadt, L.L.P.

(57) ABSTRACT

There is provided a toner which contains at least a binder resin, and filler including a layered inorganic compound, wherein the layered inorganic compound is cleaved to form particles in the toner, and the particles have a breadth of 0.5 nm to 4 nm, and a length of 10 nm to 90 nm.

15 Claims, 9 Drawing Sheets

U.S. PATENT DOCUMENTS 7,166,404 B2 1/2007 Matsuda et al.
7,169,522 B2 1/2007 Sugiura et al.
7,169,525 B2 1/2007 Sugiura et al.
7,172,844 B2 2/2007 Umemura et al.
7,179,577 B2 2/2007 Matsuda et al.
7,226,713 B2 6/2007 Yamashita et al.
7,258,959 B2 8/2007 Nakayama et al.
7,261,989 B2 8/2007 Sugiura et al.
7,272,347 B2 9/2007 Yamashita et al.
7,288,353 B2 10/2007 Sugiura et al.
7,309,558 B1 12/2007 Michel et al.
7,892,714 B2 * 2/2011 McDougall et al. ..... 430/108.3
2002/0039698 A1 4/2002 Sasaki et al.
2003/0096185 A1 5/2003 Yamashita et al.
2003/0152857 A1 8/2003 Sugiura et al.
2003/0180643 A1 9/2003 Suzuki et al.
2003/0190543 A1 10/2003 Sugiura et al.
2004/0067189 A1 4/2004 Sugiura et al.
2004/0072091 A1 4/2004 Mochizuki et al.
2004/0131961 A1 7/2004 Watanabe et al.
2004/0157146 A1 8/2004 Tomita et al.
2004/0229147 A1 11/2004 Higuchi et al.
2005/0026064 A1 2/2005 Sugiura et al.
2005/0089786 A1 4/2005 Sugiura et al.
2005/0089787 A1 4/2005 Uchinokura et al.
2005/0112488 A1 5/2005 Yamada et al.
2005/0164114 A1 7/2005 Yagi et al.
2005/0180786 A1 8/2005 Yamada et al.
2005/0186498 A1 8/2005 Honda et al.
2005/0208408 A1 9/2005 Uchinokura et al.
2005/0208411 A1 9/2005 Nakayama et al.
2005/0277040 A1 12/2005 Michel et al.
2006/0020069 A1 1/2006 Michel et al.
2006/0024097 A1 2/2006 Yamada et al.
2006/0029433 A1 2/2006 Saito et al.
2006/0063081 A1 3/2006 Nagatomo et al.
2006/0154168 A1 7/2006 Tomita et al.
2006/0165989 A1 7/2006 Takikawa et al.
2006/0172215 A1 8/2006 Kotsugai et al.
2006/0204883 A1 9/2006 Nakayama et al.
2006/0240349 A1 10/2006 Watanabe et al.
2007/0020546 A1 1/2007 Emoto et al.
2007/0031748 A1 2/2007 Kotsugai et al.
2007/0031752 A1 2/2007 Watanabe et al.
2007/0059063 A1 3/2007 Nakayama et al.
2007/0134581 A1 6/2007 Uchinokura et al.
2007/0184370 A1 8/2007 Yamashita et al.
2007/0190444 A1 8/2007 Kotsugai et al.
2007/0218380 A1 9/2007 Uchinokura et al.
2007/0275315 A1 * 11/2007 Nagatomo et al. ..... 430/108.1

FOREIGN PATENT DOCUMENTS

JP 2006-47743 2/2006
JP 2007-199655 8/2007
JP 2007-272205 10/2007
WO WO 2008001702 A1 * 1/2008

* cited by examiner

TONER, DEVELOPER, TONER CONTAINER, PROCESS CARTRIDGE, IMAGE FORMING METHOD, AND IMAGE FORMING APPARATUS

BACKGROUND OF THE INVENTION

1. Field of the Invention

The present invention relates to a toner used for developing latent electrostatic images in electrophotography, a latent electrostatic recording method, a latent electrostatic printing method, or the like, and also relates to a developer, a toner container, a process cartridge, an image forming method, and an image forming apparatus all of which utilizes the toner.

2. Description of the Related Art

In electrophotography, a latent electrostatic image is formed on a latent electrostatic image bearing member (also referred as to "image bearing member" or "photoconductor" hereinafter) by charging and partially exposing the image bearing member, and thereafter the latent electrostatic image is developed using a developer containing a toner to thereby form a toner image. This toner image is transferred onto a recording medium, and then fixed. In the mean time, the toner remained on the image bearing member without being transferred to the recording medium is cleaned by means of a cleaning member such as a blade disposed so as to contact with a surface of the image bearing member with a certain pressure.

As one of manufacturing methods of the toner, a pulverization method has been known. The pulverization method is a method in which a toner is manufactured by melting and mixing toner components which contain a thermoplastic resin as a binder resin added with a coloring agent and optionally additives, pulverizing the mixture, and then classifying the pulverized products. The toner obtained from this method has shortcomings such that a diameter of the particles becomes large, and thus high-quality images cannot be provided.

In order to overcome the shortcomings of the pulverization method, there has been proposed a method for producing a toner using a polymerization method and an emulsion-dispersion method. As the polymerization method, a suspension-polymerization method, an aggregation method, and the like are known. The suspension-polymerization method is a method in which monomers, a polymerization initiator, a coloring agent, a charge controlling agent, and the like are added to an aqueous medium containing a dispersant while stirring to thereby obtain oil droplets, and then the oil droplets are polymerized to produce a toner. The aggregation method is a method in which particles obtained by emulsion-polymerization or suspension-polymerization are aggregated, and then fused to produce a toner. These methods realize the downsizing of the particle diameter of the toner, but a material for use as a main component of the binder resin is limited to polymers obtainable from radical polymerizations. Therefore, there is still a shortcoming such that a toner cannot be produced using, as a main component of the binder resin, polyester, epoxy resin, or the like which is suitable for the production of a color toner.

Under considering these circumstances, there have been proposed methods for producing a toner using an emulsion-dispersion method wherein a mixture containing a binder resin, a coloring agent, and the like is mixed with an aqueous medium and then emulsified so as to produce a toner (refer to Japanese Patent Application Laid-Open (JP-A) Nos. 05-66600 and 08-211655). According to these proposed methods, a toner having a small particle diameter can be attained while maintaining the varieties of usable binder resins therefore. However, there are problems in the emulsion-dispersion methods such that fine particles are formed, and a loss is made in emulsification.

There has been also proposed methods for producing a toner wherein polyester is emulsified and dispersed to produce particles, and the obtained particles are aggregated and fused to produce a toner (refer to JP-A Nos. 10-020552 and 11-007156). According to these proposed methods, the generation of fine particles can be prevented, and thus the loss made in emulsification can be reduced.

Moreover, the toner obtained from the polymerization method and the emulsification-dispersion method tends to have a spherical shape due to surface tension of droplets generated in the dispersion process. Therefore, in the case where a toner is used in an apparatus utilizing a blade cleaning system, the spherical toner is rolled between the cleaning blade and the photoconductor and goes into the space between the cleaning blade and the photoconductor, and thus it is difficult to clean.

There has been also proposed a method for obtaining aggregated particles having a particle diameter of 5 μm to 25 μm wherein particles are aggregated by using polyvinyl alcohol having a certain saponification degree as a dispersant (refer to Japanese Patent (JP-B) No. 2748419). However, the aggregated particles obtained in this manner tend to have a large particle diameter.

Moreover, there has been proposed a method for deforming particles by adding toner components in an organic solvent together with filler (refer to JP-A No. 2005-49858). However, in this method, a viscoelasticity of the toner is reduced as a result of the addition of the filler, and thus the low temperature fixing is inhibited. In the case where the filler is locally positioned on the surface of the toner, bleeding of wax or a binder resin is inhibited by the filler, and thus low temperature fixing ability and hot-offset resistance are degraded.

It has been also developed a charge controlling agent wherein ions such as metal cations present between layers of a layered inorganic compound are modified with ions such as organic cations, and has been proposed a use of such the charge controlling agent in a toner for electrophotography (refer to JP-A Nos. 2003-515795, 2006-500605, 2006-503313, and 2003-202708). There has been also proposed a method wherein organic ions are made intercalating between layers of a layered inorganic compound (refer to JP-A No. 05-57288). Moreover, there has been proposed to improve capability of a layered inorganic compound to an organic solvent by intercalating certain organic ions having a polyoxypropylene group to thereby attaining stable thickening effect towards a certain organic solvent for a long period (refer to JP-B No. 3502993).

However, there have not been provided or proposed a toner which excels in low temperature fixing, is capable of forming high quality image, and has stable cleaning properties for a long period, and related technologies thereof. Therefore, there are strong demands for further improvements or developments of such the toner and related technologies.

BRIEF SUMMARY OF THE INVENTION

The present invention aims at providing a toner which has an excellent low temperature fixing ability, is capable of forming a high quality image, and provides stable cleaning properties for a long-period of time, and also providing a developer, a toner container, a process cartridge, an image forming method, and an image forming apparatus, all of which use the aforementioned toner.

The means for solving the aforementioned problems in the art are as follows:

<1> A toner containing at least: a binder resin; and filler containing a layered inorganic compound, wherein the layered inorganic compound is cleaved to form particles in the toner, and the particles have a breadth of 0.5 nm to 4 nm, and a length of 10 nm to 90 nm.

<2> The toner according to <1>, wherein the layered inorganic compound is a smectite group clay mineral.

<3> The toner according to <2>, wherein the smectite group clay mineral is a synthetic smectite expressed by the following general formula 1:

$$Na_{0.1-1.0}Mg_{2.4-2.9}Li_{0.1-0.6}Si_{3.5-4.5}O_{9.5-10.5}(X)_{1.5-2.5} \quad \text{General formula 1}$$

wherein X denotes at least one selected from OH and F, and wherein the synthetic smectite is obtained by reacting a mixed solution of silicic acid and magnesium salt with an alkaline solution to synthesize a silicon-magnesium complex, removing electrolyte which is a by-product of the reaction, adding lithium ions together with at least one selected from sodium ions and fluorine ions to the silicone-magnesium complex so as to subject the mixture a hydrothermal reaction.

<4> A toner containing at least: a binder resin; and filler containing a layered inorganic compound, wherein the layered inorganic compound contains a synthetic smectite expressed by the following general formula 1:

$$Na_{0.1-1.0}Mg_{2.4-2.9}Li_{0.1-0.6}Si_{3.5-4.5}O_{9.5-10.5}(X)_{1.5-2.5} \quad \text{General formula 1}$$

wherein X denotes at least one selected from OH and F, and wherein the synthetic smectite is obtained by reacting a mixed solution of silicic acid and magnesium salt with an alkaline solution to synthesize a silicon-magnesium complex, removing electrolyte which is a by-product of the reaction, adding lithium ions together with at least one selected from sodium ions and fluorine ions to the silicone-magnesium complex so as to subject the mixture a hydrothermal reaction.

<5> The toner according to any one of <1> to <4>, wherein the layered inorganic compound is treated with an organification agent.

<6> The toner according to <5>, wherein the organification agent is a quaternary ammonium ion expressed by the following general formula 2:

General formula 2

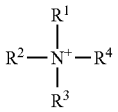

wherein $R^1$ denotes a C1-30 alkyl group or a benzyl group; $R^2$ and $R^3$ each denote a group expressed by $—(CH_2CH(CH_3)O)_nH$, a group expressed by $—(CH_2CH_2CH_2O)_nH$, or a C1-30 alkyl group; $R^4$ denotes a group expressed by $—(CH_2CH(CH_3)O)_nH$, or a group expressed by $—(CH_2CH_2CH_2O)_nH$; and n denotes an integer of 5 to 50.

<7> The toner according to any one of <1> to <6>, wherein the toner has a filler layer comprising the layered inorganic compound in an area adjacent to a surface of the toner.

<8> The toner according to any one of <1> to <7>, wherein a content of the layered inorganic compound in the toner is 0.5% by mass to 5% by mass.

<9> The toner according to any one of <1> to <8>, wherein the layered inorganic compound has a cation exchange capacity of 80 me/100 g to 120 me/100 g.

<10> The toner according to any one of <1> to <9>, wherein the toner is obtained by dissolving or dispersing a toner material comprising an active hydrogen group containing compound, a polymer reactive with the active hydrogen group containing group, a binder resin and the filler in an organic solvent so as to prepare a toner solution, emulsifying or dispersing the toner solution in an aqueous medium so as to prepare an emulsified dispersion, reacting the active hydrogen group containing compound and the polymer reactive with the active hydrogen group containing compound in the aqueous medium so as to generate an adhesive base in the shape of particles, and removing the organic solvent.

<11> The toner according to <10>, wherein the organic solvent is ethyl acetate.

<12> The toner according to any one of <10> or <11>, wherein the binder resin contains non-modified polyester, and wherein a mass ratio (polymer/non-modified polyester) of the polymer reactive with the active hydrogen group containing compound to the non-modified polyester is 5/95 to 80/20.

<13> The toner according to any one of <1> to <12>, wherein the toner has an average circularity of 0.925 to 0.970.

<14> The toner according to any one of <1> to <13>, wherein the toner has a volume average diameter (Dv) of 3 μm to 10 μm, and a ratio (Dv/Dn) of 1.00 to 1.30 wherein the ratio (Dv/Dn) is a ratio of the volume average particle diameter to a number average particle diameter.

<15> A developer containing: carrier; and the toner as defined in any one of <1> to <14>.

<16> A toner container containing: the toner as defined in any one of <1> to <14>; and a container which houses the toner therein.

<17> A process cartridge containing: a latent electrostatic image bearing member; a developing unit configured to develop a latent electrostatic image formed on the latent electrostatic image bearing member with the toner as defined in any one of <1> to <14> so as to form a visible image, wherein the process cartridge is attachable to, and detachable from a body of an image forming apparatus.

<18> An image forming method, containing: forming a latent electrostatic image on a latent electrostatic image bearing member; developing the latent electrostatic image using the toner as defined in any one of <1> to <14> so as to form a visible image; transferring the visible image onto a recording medium; and fixing the transferred image on the recording medium.

<19> An image forming apparatus containing at least: a latent electrostatic image bearing member; a latent electrostatic image forming unit configured to form a latent electrostatic image on the latent electrostatic image bearing member; a developing unit configured to develop the latent electrostatic image using the toner as defined in any one of <1> to <14> so as to form a visible image; a transferring unit configured to transfer the visible image onto a recording medium; and a fixing unit configured to fix the transferred image on the recording medium.

In the first embodiment, the toner of the present invention contains at least a binder resin and filler containing a layered inorganic compound, wherein the layered inorganic compound is cleaved to form particles in the toner, and the particles have a breadth of 0.5 nm to 4 nm, and a length of 10 nm to 90 nm.

In the second embodiment, the toner of the present invention contains at least a binder resin, and filler containing a layered inorganic compound, wherein the layered inorganic compound contains a synthetic smectite expressed by the following general formula 1:

$$Na_{0.1-1.0}Mg_{2.4-2.9}Li_{0.1-0.6}Si_{3.5-4.5}O_{9.5-10.5}(X)_{1.5-2.5} \quad \text{General formula 1}$$

wherein X denotes at least one selected from OH and F, and wherein the synthetic smectite is obtained by reacting a mixed solution of silicic acid and magnesium salt with an alkaline solution to synthesize a silicon-magnesium complex, removing electrolyte which is a by-product of the reaction, adding lithium ions together with at least one selected from sodium ions and fluorine ions to the silicone-magnesium complex so as to subject the mixture a hydrothermal reaction.

Since the toner according to any of the first or second embodiment contains the certain layered inorganic compound as mentioned above, the toner can be suitably irregularly shaped, has an excellent low temperature fixing ability and stable cleaning properties for a long-period of time, and is capable of forming a high quality image.

The developer of the present invention contains the toner of the present invention. Therefore, when an image formation is carried out by using the developer in accordance with an electrophotographic method, a low temperature fixing ability is improved, stable cleaning properties are attained for a long-period of time, and high quality images can be provided.

The toner container for use in the present invention contains the toner of the present invention in the container. Therefore, when an image formation is carried out by using the toner contained in the toner container in accordance with an electrophotographic method, a low temperature fixing ability is improved, stable cleaning properties are attained for a long-period of time, and excellent precisely defined images can be provided.

The process cartridge for use in the present invention contains a latent electrostatic image bearing member, a developing unit configured to develop a latent electrostatic image formed on the latent electrostatic image bearing member with the toner of the present invention so as to form a visible image. The process cartridge is attachable to, and detachable from a body of an image forming apparatus, has excellent convenience in handling, and uses the toner of the present invention. As a result, a low temperature fixing ability is improved, stable cleaning properties can be attained for a long-period of time, and high quality images can be provided.

The image forming apparatus for use in the present invention contains at least a latent electrostatic image bearing member, a latent electrostatic image forming unit, a developing unit, a transferring unit, and a fixing unit. In the image forming apparatus, the latent electrostatic image forming unit forms a latent electrostatic image on the latent electrostatic image bearing member. The developing unit develops the latent electrostatic image using the toner of the present invention so as to form a visible image. The transferring unit transfers the visible image onto a recording medium. The fixing unit fixes the transferred image on the recording medium. As a result, a low temperature fixing ability is improved, stable cleaning properties can be attained for a long-period of time, and high quality electrophotographic images can be provided.

The image forming method of the present invention contains at least a latent electrostatic image forming step, a developing step, a transferring step, and a fixing step. In the latent electrostatic image forming step, a latent electrostatic image is formed on a latent electrostatic image bearing member. In the developing step, the latent electrostatic image is developed using the toner of the present invention to form a visible image. In transferring step, the visible image is transferred onto a recording medium. In the fixing step, the transferred image is fixed on the recording medium. As a result, a low temperature fixing ability is improved, stable cleaning properties can be attained for a long-period of time, and high quality electrophotographic images can be provided.

DETAILED DESCRIPTION OF THE INVENTION (Toner)

Figure 1:
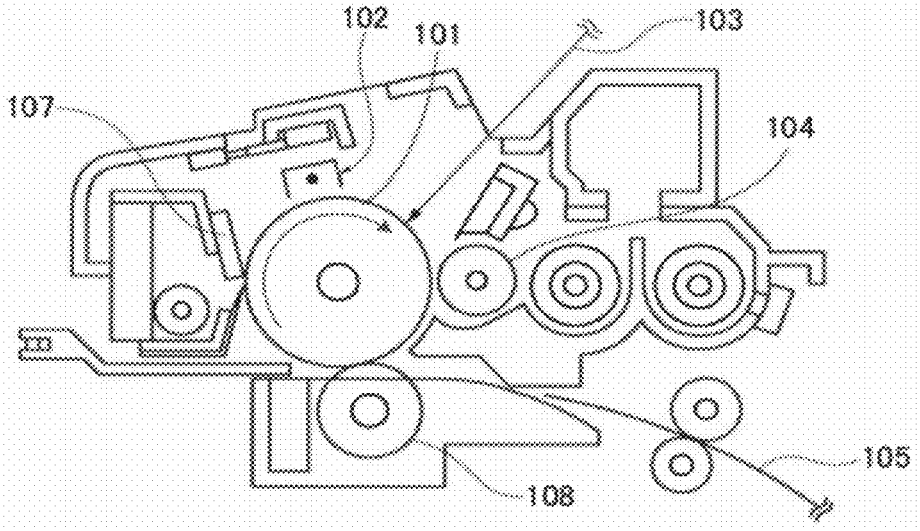
FIG. 1 is a schematic diagram showing an example of a process cartridge for use in the present invention.

The toner of the present invention contains at least a binder resin and filler, and further contains other components, if necessary.

In the first embodiment of the toner, the filler contains a layered inorganic compound, wherein the layered inorganic compound is cleaved to form particles within the toner and the particles have a breadth of 0.5 nm to 4 nm, and a length of 10 nm to 90 nm.

In the second embodiment of the toner, the filler contains a layered inorganic compound, wherein the layered inorganic compound contains a synthetic smectite expressed by the following general formula 1:

$$Na_{0.1\text{-}1.0}Mg_{2.4\text{-}2.9}Li_{0.1\text{-}0.6}Si_{3.5\text{-}4.5}O_{9.5\text{-}10.5}(X)_{1.5\text{-}2.5} \quad \text{General formula 1}$$

In the general formula 1, X denotes at least one selected from OH and F.

In addition, the synthetic smectite is obtained by reacting a mixed solution of silicic acid and magnesium salt with an alkaline solution to synthesize a silicon-magnesium complex, removing electrolyte which is a by-product of the reaction, adding lithium ions together with at least one selected from sodium ions and fluorine ions to the silicone-magnesium complex so as to subject the mixture hydrothermal reaction to thereby yield the synthetic smectite.

<Filler>

The filler for use in the present invention contains a layered inorganic compound. Such the layered inorganic compound brings a suitable hydrophobic nature to the toner, and gives non-Newtonian viscosity to an oil phase containing at least the binder resin and the filler in the process of producing a toner, and thus the toner can be irregularly shaped.

-Layered Inorganic Compound-

The layered inorganic compound defines an inorganic compound having a structure such that sheets, in which atoms are strongly bonded by a covalent bonding or the like and are closely arranged, are substantially horizontally laminated by weak force such as van der Waals force, static electricity, or the like. Such the inorganic compound is swollen or cleaved by arranging or absorbing solvents in between the layers.

Examples of the layered inorganic compound are hydrous silicate having swelling properties. Specific examples thereof include: smectite group clay minerals such as bentonite, montmorillonite, beidellite, nontronite, saponite, hectorite, sauconite, stevensite, and the like; vermiculite group clay minerals such as vermiculite, and the like; kaolin minerals such as halloysite, kaolinite, endellite, dicite, and the like; phyllosilicates such as talc, pyrophyllite, mica, margarite, muscovite, phlogopite, tetrasilicic mica, taeniolite, and the like; serpentine group minerals such as antigorite and the like; chlorite group minerals such as chlorite, cookeite, nimite, and the like. These layered inorganic compounds can be of natural products or of synthetic products. These can be singly used or used in combination of two or more, as the layered inorganic compound in the toner of the present invention. Among these examples, natural or synthetic smectite group clay minerals are particularly preferable to use, since such the clay minerals do not adversely affect toner properties and an addition amount thereof can be kept small.

Suitable examples of the synthetic smectite include the one expressed by the following general formula 1:

$$Na_{0.1\text{-}1.0}Mg_{2.4\text{-}2.9}Li_{0.1\text{-}0.6}Si_{3.5\text{-}4.5}O_{9.5\text{-}10.5}(X)_{1.5\text{-}2.5} \quad \text{General formula 1}$$

In the general formula 1, X denotes at least one selected from OH and F.

The synthetic smectite expressed by the general formula 1 is obtained by reacting a mixed solution of silicic acid and magnesium salt with an alkaline solution to synthesize a silicon-magnesium complex, removing electrolyte which is a by-product of the reaction, adding lithium ions together with at least one selected from sodium ions and fluorine ions to the silicone-magnesium complex so as to subject the mixture hydrothermal reaction to thereby yield the synthetic smectite.

The layered inorganic compound can replace (intercalate) ions such as metal cations present between the layered with organic ions.

The cation exchange capacity of the layered inorganic compound is preferably 80 me/100 g to 120 me/100 g, more preferably 90 me/100 g to 110 me/100 g. In the case where the cation exchange capacity of the layered inorganic compound is less than 80 me/100 g, the exchanged amount of the organic ions is small, and thus the solubility of the layered inorganic compound to the solvent becomes low, or the layered inorganic compound loses compatibility to the resins contained in the toner. As a result, the amount of the layered inorganic compound contained in the toner becomes small, and therefore the irregularity of the toner shape becomes insufficient. In the case where the cation exchange capacity of the layered inorganic compound is more than 120 me/100 g, the exchanged amount of the organic ions is excessive, and the excessive amount of the organic substances makes the resins contained in the toner plasticized. As a result, the fixing ability of the toner, especially the hot-offset resistance, is deteriorated.

The above-mentioned cation exchange capacity can be measured in the following manner. For example, cations saturating exchange groups in the layered inorganic compound are replaced and saturated with ammonium ions by using a solution of ammonium acetate, the excessive ammonium acetate is washed with alcohol, and then the ammonium ions are exchanged and effused by using a solution of potassium chloride. The thus obtained ammonium ions were quantified to calculate the cation exchange capacity. The quantification of the ammonium ions can be carried out in accordance with an indophenol method wherein a mixed solution of potassium hydroxide, phenol and sodium nitroprusside, and a solution of sodium hypochlorite are added to a sample, where the subjective ammonium ions are contained, so as to allow indophenol emit color of blue. Thereafter, the emitted color is compared with a standard to thereby quantify the amount of ammonium ions.

The layered inorganic compound is preferably treated with an organification agent to thereby being dissolved and/or dispersed in an organic solvent. Such the treated layered inorganic compound can be uniformly dispersed in an oil phase in which toner components are dissolved as the layered inorganic compound has an affinity to the oil phase. When a mixture of the oil phase wherein at least the layered inorganic compound and the toner components are dissolved and an aqueous phase is emulsified by adding shear force, the layered inorganic compound moves towards the surface of the toner oil droplet as the layered inorganic compound is hydrophilic. At that time, the viscosity of the surface portion of the toner oil droplet becomes high and thus the toner oil droplet can be easily shaped irregularly. Use of the layered inorganic compound in the toner is preferable in view of that it exhibits charge controlling functions when dispersed and finely cleavage in the toner, and also a large amount thereof can be present in the surface portion of the toner particles.

The organic solvent can be appropriately selected depending on the purpose without any restrictions. Examples thereof include acetone (propanone), methyl alcohol, ethyl alcohol, isopropyl alcohol, tetrahydrofurane (THF), ethyl acetate, and the like. Among these, ethyl acetate is especially preferable.

The aforementioned organification treatment can be performed by allowing the layered inorganic compound to contain a compound containing an onium ion. Specifically, the layered inorganic compound is treated by adding an organification agent containing an organic onium ion. The organic onium ion can be appropriately selected depending on the purpose without any restrictions. Examples thereof include primary to a quaternary ammonium ion of mono alkyl, a secondary to tertiary ammonium ion of dialkyl, a tertiary to quaternary ammonium ion of trialkyl, a tetra alkyl ammonium ion, and the like. Among these, a quaternary ammonium ion is preferable, and a quaternary ammonium ion expressed by the following general formula 2 is particularly preferable:

General formula 2

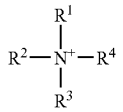

In the general formula 2, $R^1$ denotes a C1-30 alkyl group or benzyl group; $R^2$ and $R^3$ each denote a group expressed by $—(CH_2CH(CH_3)O)_nH$, a group expressed by $—(CH_2CH_2CH_2O)_nH$, or a C1-30 alkyl group; $R^4$ denotes a group expressed by $—(CH_2CH(CH_3)O)_nH$, or a group expressed by $—(CH_2CH_2CH_2O)_nH$; and n denotes an integer of 5 to 50.

Examples of a quaternary ammonium salt containing such the quaternary ammonium ion are dimethyldioctadecylammonium bromide, trimethyloctadecylammonium chloride, benzyltrimethylammonium chloride, dimethylbenzyloctadecylammonium bromide, trioctylmethylammonium chloride, polyoxypropylene trimethyl ammonium chloride, di(polyoxypropylene) dimethylammonium chloride, di(polyoxyethylene) dodecylmethylammonium chloride, tri(polyoxypropylene) methylammonium chloride, tri(polyoxypropylene) methylammonium bromide, a compound expressed by the following formula:

$CH_3(CH_3CH_2)_2N^+(CH_2CHOCH_3)_{25}H.CL^-$, and the like. Among these, the compound expressed by the following formula:

$CH_3(CH_3CH_2)_2N^+(CH_2CHOCH_3)_{25}H.CL^-$ is particularly preferable.

As the organification-treated layered inorganic compound, the commercially available products can be used. Examples of the commercial products include Somashifu MAE, MTE, MEE, MPE (all synthetic micas, manufactured by CO—OP Chemical Industries, Ltd.), and Lucentite SAN, STN, SEN, SPN (all synthetic semectite, manufactured by CO—OP Chemical Industries, Ltd.), and the like.

The layered inorganic compound is cleaved and present in the toner in the form of layered or flat particles, but the planar shape thereof is not particularly limited, and may be non-regulated shape.

The particles formed by cleaving the layered inorganic compound has a breadth of 0.5 nm to 4 nm, preferably 0.5 nm to 2 nm, and has a length of 10 nm to 90 nm, preferably 30 nm to 60 nm.

The breadth and length of the particles can be determined, for example, by SEM observation. Preferably, the average breadth thereof can be determined based on the interlayer distance measured, for example, by X-ray diffraction.

The organification-treated layered inorganic compound is used in a manner such that the layered inorganic compound is sufficiently dispersed in an organic solvent, and a solvent wherein a hydrophobic binder resin is dissolved and/or dispersed is added thereto. Alternatively, the solvent wherein the organification-treated layered inorganic compound is dispersed is added to the solvent of the hydrophobic binder resin.

Moreover, as a method for directly adding the layered inorganic compound to the hydrophobic binder resin, the following method can be used such that the layered inorganic compound is added to the hydrophobic binder resin while dispersing the layered inorganic compound therein, by adding the layered inorganic compound to the melting state of the hydrophobic binder resin, and kneading thereof.

The content of the layered inorganic compound as the filler in the toner is preferably 0.5% by mass to 5% by mass, more preferably 1% by mass to 2.5% by mass. In the case where the content is less than 0.5% by mass, the amount of the layered inorganic compound present in the toner, especially in the area adjacent to the surface of the toner, becomes small, and thus the irregularities of the toner shape may be insufficient. In the case where the content is more than 5% by mass, the amount of the layered inorganic compound present in the toner, especially in the area adjacent to the surface of the toner, becomes large, and thus the fixing ability of the toner, especially cold offset resistance, may degrade.

The toner preferably has a filler layer containing the layered inorganic compound at an area adjacent to the surface of the toner (area which is within the depth of 0.5 μm from the surface of the toner). The filler layer is preferably present in the whole area of the surface of the toner, but may be present intermittently through the surface of the toner. The filler layer may also be laminated to form a plurality of layers.

The presence of the filler layer formed in the area adjacent to the surface of the toner can be confirmed, for example, by observing a cross section of a sample in which the toner is embedded in an epoxy resin under a scanning electron microscope (SEM) to confirm the profile of the toner particle, and observing the same view on a backscattering electron image. As elements having more mass than carbon, which are main components of the toner, can be identified as the backscattering electron image, the position of the layered inorganic compound, namely the presence of the filler layer, can be confirmed by detecting the presence of magnesium and silicon which are substances obtained in the layered inorganic compound.

The production method or materials of the toner can be appropriately selected from the method or materials known in the art depending on the purpose, without any restrictions, provided that the aforementioned requirements are satisfied. However, the toner obtained in the following manner is preferable, as a resin for use can be selected from the wide varieties, it has a good low temperature fixing ability and excellent granulating properties, and it is easy to control a particle diameter, a particle size distribution, and a particle shape. Namely, such the toner is the one obtained by dissolving and/or dispersing the toner material containing an active hydrogen group containing compound, a polymer reactive with the active hydrogen group containing compound, a binder resin, and filler in an organic solvent so as to prepare a toner solution, emulsifying and/or dispersing the toner solution in an aqueous medium so as to prepare a dispersion, reacting the active hydrogen group containing compound and the polymer reactive with the active hydrogen group containing compound in the aqueous medium so as to generate a adhesive base in the shape of particles, and removing the organic solvent therefrom.

The toner material contains at least the active hydrogen group containing compound, the polymer reactive with the active hydrogen group containing compound, the binder resin, and the filler, and optionally contains other substances such as a coloring agent, a releasing agent, resin particles, a charge controlling agent, and the like, if necessary.

-Adhesive Base-

The adhesive base exhibits adhesive properties against a recording medium such as a paper, and contains an adhesive polymer obtained by reacting the active hydrogen group containing compound and the polymer reactive with the active hydrogen containing compound in the aqueous medium. The adhesive base may further contain a binder resin appropriately selected from binder resins known in the art.

The weight average molecular weight of the adhesive base is appropriately adjusted depending on the purpose, without any restrictions. For example, the weight average molecular weight thereof is preferably 1,000 or more, more preferably 2,000 to 10,000,000, particularly preferably 3,000 to 1,000,000.

In the case where the weight average molecular weight thereof is less than 1,000, the hot offset resistance may be deteriorated.

The storage modulus of the adhesive base is appropriately adjusted depending on the purpose, without any restrictions. For example, it is 10,000 dyne/cm$^2$ at a temperature (TG') of 100° C. or higher, preferable 110° C. to 200° C., when measured at a frequency of 20 Hz. In the case where TG' is lower than 100° C., the hot offset resistance may be deteriorated.

The viscosity of the adhesive base is appropriately adjusted depending on the purpose, without any restrictions. For example, it is 1,000 poise at a temperature (Tη) of 180° C. or lower, preferable 90° C. to 160° C., when measured at a frequency of 20 Hz. In the case where Tη is higher than 180° C., the low temperature fixing ability may be deteriorated.

In view of realizing both the hot offset resistance and the low temperature fixing ability, the TG' is preferably higher than Tη. Specifically, a difference (TG'−Tη) between TG' and Tη is preferably 0° C. or more, more preferably 10° C. or more, further more preferably 20° C. or more. The larger difference is more preferable.

Moreover, in view of realizing both the low temperature fixing ability and the heat resistant stability, a difference (TG'−Tη) between TG' and Tη is preferably 0° C. to 100° C., more preferably 10° C. to 90° C., further more preferably 20° C. to 80° C.

The specific example of the adhesive base is appropriately selected depending on the purpose without any restrictions. Suitable examples thereof include polyester, and the like.

The polyester is appropriately selected depending on the purpose without any restrictions. Suitable examples thereof include urea-modified polyester, and the like.

The urea-modified polyester is obtained by reacting amines (B) as the active hydrogen group containing compound and an isocyanate group containing polyester prepolymer (A) as the polymer reactive with the active hydrogen group containing compound, in the aqueous medium.

The urea-modified polyester may contain a urethane bonding, as well as a urea bonding. In this case, a mole ratio (urea bonding/urethane bonding) of the urea bonding to the urethane bonding is appropriately adjusted depending on the purpose without any restrictions, but is preferably 100/0 to 10/90, more preferably 80/20 to 20/80, particularly preferably 60/40 to 30/70.

In the case where the mole ratio of the urea bonding is less than 10, the hot offset resistance may be deteriorated.

Suitable specific examples of the urea-modified polyester include the following (1)-(10):

(1) a mixture of: a polycondensation product of 2 mol ethyleneoxide adduct of bisphenol A and isophthalic acid; and a compound obtained by urea-modifying a polyester prepolymer with isophorone diamine, wherein the polyester prepolymer is obtained by reacting a polycondensation product of 2 mol ethyleneoxide adduct of bisphenol A and isophthalic acid with isophorone diisocyanate.

(2) a mixture of a polycondensation product of 2 mol ethylene oxide adduct of bisphenol A and terephthalic acid; and a compound obtained by urea-modifying a polyester prepolymer with isophorone diamine, wherein the polyester prepolymer is obtained by reacting a polycondensation product of 2 mol ethylene oxide adduct of bisphenol A and isophthalic acid with isophorone diisocyanate.

(3) a mixture of: a polycondensation product of 2 mol ethylene oxide adduct of bisphenol A, 2 mol propylene oxide adduct of bisphenol A, and terephthalic acid; and a compound obtained by urea-modifying a polyester prepolymer with isophorone diamine, wherein the polyester prepolymer is obtained by reacting a polycondensation product of 2 mol ethylene oxide adduct of bisphenol A, 2 mol propylene oxide adduct of bisphenol A, and terephthalic acid with isophorone diisocyanate.

(4) a mixture of: a polycondensation product of 2 mol propylene oxide adduct of bisphenol A, and terephthalic acid; and a compound obtained by urea-modifying a polyester prepolymer with isophorone diamine, wherein the polyester prepolymer is obtained by reacting a polycondensation product of 2 mol ethylene oxide adduct of bisphenol A, 2 mol propylene oxide adduct of bisphenol A, and terephthalic acid with isophorone diisocyanate.

(5) a mixture of: a polycondensation product of 2 mol ethylene oxide adduct of bisphenol A, and terephthalic acid; and a compound obtained by urea-modifying a polyester prepolymer with hexamethylene diamine, wherein the polyester prepolymer is obtained by reacting a polycondensation product of 2 mol ethylene oxide adduct of bisphenol A, and terephthalic acid with isophorone diisocyanate.

(6) a mixture of: a polycondensation product of 2 mol ethylene oxide adduct of bisphenol A, 2 mol propylene oxide adduct of bisphenol A, and terephthalic acid; and a compound obtained by urea-modifying a polyester prepolymer with hexamethylene diamine, wherein the polyester prepolymer is obtained by reacting a polycondensation product of 2 mol ethylene oxide adduct of bisphenol A, and terephthalic acid with isophorone diisocyanate.

(7) a mixture of: a polycondensation product of 2 mol ethylene oxide adduct of bisphenol A, and terephthalic acid; and a compound obtained by urea-modifying a polyester prepolymer with ethylene diamine, wherein the polyester prepolymer is obtained by reacting a polycondensation product of 2 mol ethylene oxide adduct of bisphenol A, and terephthalic acid with isophorone diisocyanate.

(8) a mixture of: a polycondensation product of 2 mol ethylene oxide adduct of bisphenol A, and isophthalic acid; and a compound obtained by urea-modifying a polyester prepolymer with hexamethylene diamine, wherein the polyester prepolymer is obtained by reacting a polycondensation product of 2 mol ethylene oxide adduct of bisphenol A, and isophthalic acid with diphenylmethane diisocyanate.

(9) a mixture of: a polycondensation product of 2 mol ethylene oxide adduct of bisphenol A, 2 mol propylene oxide adduct of bisphenol A, and terephthalic acid; and a compound obtained by urea-modifying a polyester prepolymer with hexamethylene diamine, wherein the polyester prepolymer is obtained by reacting a polycondensation product of 2 mol ethylene oxide adduct of bisphenol A, 2 mol propylene oxide adduct of bisphenol A, terephthalic acid, and dodecenylsuccinic anhydride with diphenylmethane diisocyanate.

(10) a mixture of a polycondensation product of 2 mol ethylene oxide adduct of bisphenol A, and isophthalic acid; and a compound obtained by urea-modifying a polyester prepolymer with hexamethylene diamine, wherein the polyester prepolymer is obtained by reacting a polycondensation product of 2 mol ethylene oxide adduct of bisphenol A, and isophthalic acid with toluene diisocyanate.

-Active Hydrogen Group Containing Compound-

The active hydrogen group containing compound functions as an elongation agent, crosslinking agent, and the like in the aqueous medium at the time when the polymer reactive with the active hydrogen group containing compound undergoes an elongation reaction, crosslinking reaction, and the like.

The active hydrogen group containing compound is appropriately selected without any restrictions, provided that it contains one or more active hydrogen groups. In the case where the polymer reactive with the active hydrogen group containing compound is the isocyanate group containing polyester prepolymer (A), the active hydrogen group containing compound is preferably amine (B) in view of the resulting polymer can have high molecular weight as a result of a reaction such as an elongation reaction, crosslinking reaction, and the like, with the isocyanate group containing polyester prepolymer (A).

The active hydrogen group is appropriately selected depending on the purpose without any restrictions. Examples thereof include a hydroxyl group (alcoholic hydroxyl group, or phenolic hydroxyl group), an amino group, a carboxyl group, a mercapto group, and the like. These can be used singly, or in combination of two or more. Among these, the alcoholic hydroxyl group is particularly preferable.

The amine (B) can be appropriately selected depending on the purpose without any restrictions. Examples thereof include diamine (B1), polyamine (B2), amino alcohol (B3), amino mercaptan (B4), amino acid (B5), and blocked amine (B6) in which the above-mentioned amines (B1-B5) are blocked.

There can be used singly, or in combination of two or more. Among these, diamines (B1), and a mixture of diamines (B1) and a small amount of polyamines (B2) having three or more amino groups are preferable.

Examples of the diamine (B1) include aromatic diamine, alicyclic diamine, aliphatic diamine, and the like. Examples of the aromatic diamine include phenylene diamine, diethyltoluene diamine, and 4,4'-diaminodiphenyl methane. Examples of the alicyclic diamine include 4,4'-diamino-3,3'-dimethyldicyclohexyl methane, diaminocyclohexane, and isophoron diamine. Examples of the aliphatic diamine include ethylene diamine, tetramethylene diamine, and hexamethylene diamine.

Examples of the polyamines (B2) having three or more amino groups include diethylene triamine, and triethylene tetramine.

Examples of the amino alcohol (B3) include ethanol amine, and hydroxyethyl aniline.

Examples of the amino mercaptan (B4) include aminoethyl mercaptan and aminopropyl mercaptan.

Examples of the amino acid (B5) include amino propionic acid, and amino caproic acid.

Examples of the blocked amines (B6) include keimine compounds which are prepared by reacting one of the amines B1-B5 mentioned above with ketone such as acetone, methyl ethyl ketone and methyl isobutyl ketone; and oxazoline compound.

The elongation reaction or crosslinking reaction of the active hydrogen containing compound and the polymer reactive with the active hydrogen containing compound can be terminated by using a reaction anticatalyst. A use of the reaction anticatalyst is preferable in view of that a molecular weight of the adhesive base can be controlled within the predetermined range. Examples of the reaction anticatalyst include: monoamine such as diethyl amine, dibutyl amine, butyl amine, and lauryl amine; and blocked amine such as a ketimine compound.

The mixing ratio (i.e. a mixing equivalent ratio [NCO]/[NHx]) of the prepolymer (A) having an isocyanate group to the amine (B) is preferably 1/3 to 3/1, more preferably 1/2 to 2/1, further preferably 1/1.5 to 1.5/1.

In the case where the mixing equivalent ratio [NCO]/[NHx] is less than ⅓, low temperature fixing ability is degraded. In the case where the mixing equivalent ratio is more than 3/1, a molecular weight of the urea-modified polyester becomes small, and thus hot-offset resistance is deteriorated.

-Polymer Reactive with an Active Hydrogen Containing Compound-

The polymer reactive with an active hydrogen containing compound (referred to as prepolymer hereinafter) can be appropriately selected from the conventional resins without any restrictions, provided that the polymer containing at least a portion which can react with the active hydrogen group containing compound. Examples thereof include polyol resin, poly acrylic resin, polyester resin, epoxy resin, and derivatives thereof.

These can be used singly, or in combination of two or more. Among these, the polyester resin is particularly preferable in view of high fluidity at the time being melted, and transparency.

The portion which can react with the active hydrogen group containing compound can be appropriately selected from known substituents without any restrictions. Examples thereof include an isocyanate group, an epoxy group, carboxylic acid, and an acid chloride group.

These can be used singly or in combination of two or more. Among these, the isocyanate group is particularly preferable.

Among the aforementioned prepolymers, polyester resin containing a group which generates urea bonding, i.e. reactive modified polyester (RMPE) is particularly preferable as a molecular weight of the high molecular component can be easily controlled, and it has a suitable oil-free low temperature fixing ability such that good releasing ability and fixing ability are maintained even when the device does not equip a unit for applying a releasing oil to a heating member for fixing.

Examples of the group which generates urea bonding include an isocyanate group, and the like. In the case where the group which generates urea bonding in the reactive modified polyester (RMPE) is an isocyanate group, the polyester is preferably a polyester prepolymer containing an isocyanate group (A).

The polyester prepolymer containing an isocyanate group can be appropriately selected without any restrictions. Examples thereof include compounds prepared by reacting a polycondensation product of polyol (PO) and an actove hydrogen group containing polycarboxylic acid (PC), with polyisocyanate (PIC).

The polyol (PO) can be appropriately selected without any restrictions. Examples thereof include diol (DIO), tri- or higher valent polyol (TO), and a mixture of diol (DIO) and trihydric or higher polyhydric polyol (TO). These can be used singly or in combination of two or more. Among these, single use of diol (DIO) or a mixture of diol (DIO) and trihydric or higher polyhydric polyol (TO) is preferable.

Examples of the diol (DIO) include alkylene glycol, alkylene ether glycol, alicyclic diol, an adduct of alicyclic diol with alkylene oxide, bisphenol, and an adduct of bisphenol with alkylene oxide.

Examples of the alkylene glycol include C2-12 alkylene glycols such as ethylene glycol, 1,2-propylene glycol, 1,3-propylene glycol, 1,4-butanediol, 1,6-hexanediol, and the like. Examples of the alkylene ether elycol include diethylene glycol, triethylene glycol, dipropylene glycol, polyethylene glycol, polypropylene glycol, polytetramethylene ether glycol, and the like. Examples of the alicyclic diol include q,4-cyclohexane dimethano 1, hydrogenated bisphenol A, and the like. Examples of the adduct of alicyclic diol with alkylene oxide include adducts of the aforementioned alicyclic diol with alkylene oxide such as ethylene oxide, propylene oxide, butylene oxide, and the like. Examples of the bisphenol include bisphenol A, bisphenol F, bisphenol S, and the like. Examples of the adduct of bisphenol with alkylene oxide include adducts of the aforementioned bisphenol with alkylene oxide such as ethylene oxide, propylene oxide, buthylene oxide, and the like.

Among these, C2-12 alkylene glycol, the adduct of bisphenol with alkylene oxide, and the like are preferable. Moreover, the alkylene oxide adduct of bisphenol, and a mixture of the alkylene oxide adduct of bisphenol and the C2-12 alkylene glycol are particularly preferable.

The trihydric or higher hydric polyol (TO) is preferably of valency of from 3 to 8, or even higher. Examples thereof include trihydric or higher polyhydric aliphatic alcohol, trihydric or higher polyhydric polyphenol, an adduct of trihydric or higher polyhydric polyphenol with alkylene oxide, and the like.

Examples of the trihydric or higher polyhydric aliphatic alcohol include alycerin, trimethylol ethane, trimethylol propane, pentaerythritol, and sorbitol. Examples of the trihydric or higher polyhydric polyphenol include trisphenol PA, phenol novolak, and cresol novolak. Examples of the adduct of trihydric or higher polyhydric polyphenol with alkylene oxide include adducts of the aforementioned trihydric or higher polyhydric polyphenol with alkylene oxide such as ethylene oxide, propylene oxide, butylene oxide, and the like.

The mixture of the diol and the trihydric or higher polyhydric polyol (TO) has a mass mixing ratio (DIO:TO) of preferably from 100:0.01 to 100:10, more preferably from 100:0.01 to 100:1.

The polycarboxylic acid can be appropriately selected depending on the purpose without any restrictions. Examples thereof include dicarboxylic acid (DIC), tri- or higher valent polycarboxylic acid (TC), a mixture of dicarboxylic acid (DIC) and tri- or higher valent polycarboxylic acid, and the like.

These can be used singly, or in combination of two or more. Among these, single use of dicarboxylic acid (DIC) or the mixture of DIC and a small amount of tri- or higher valent polycarboxylic acid (TC).

Examples of the dicarboxylic acid include alkylene dicarboxylic acid, alkenylene dicarboxylic acid, aromatic dicarboxylic acid, and the like.

Examples of the alkylene dicarboxylic acid include succinic acid, adipic acid, and sebacic acid. Examples of the alkenylene dicarboxylic acid include ones having carbon atoms of 4 to 20, such as maleic acid, and fumaric acid. Examples of the aromatic dicarboxylic acid include ones having carbon atoms of 8 to 20, such as phthalic acid, isophthalic acid, terephthalic acid, and naphthalene dicarboxylic acid.

Among these, C4-20 alkenylene dicarboxylic acid, and C8-20 aromatic dicarboxylic acid are preferable.

The tri- or higher valent polycarboxylic acid (TO) preferably has a valency of from three to eight, or even higher. Examples thereof include aromatic polycarboxylic acid, and the like.

Examples of the aromatic polycarboxylic acid include ones having carbon atoms of 9 to 20, such as trimellitic acid and pyromellitic acid.

As the polycarboxylic acid, it can be used an anhydride or lower alkyl ester of the one selected from the dicarboxylic acid (DIC), the tri- or higher valent polycarboxylic acid (TC), and the mixture of DIC and TC. Examples of the lower alkyl ester include methyl ester, ethyl ester, isopropyl ester, and the like.

The mixture of dicarboxylic acid (DIC) and tri- or higher valent polycarboxylic acid (TC) has a mass mixing ratio (DIC:TC) which is appropriately selected depending on the purpose without any restrictions. The mass mixing ratio (DIC:TC) is preferably 100:0.01 to 100:10, more preferably 100:0.01 to 100:1.

At the time when the polyol (PO) and the polycarboxylic acid (PC) are subjected to a polycondensation reaction, the mixing ratio thereof can be appropriately adjusted depending on the purpose without any restrictions. For example, an equivalent ratio ([OH]/[COOH]) of the hydroxyl groups [OH] in the polyol (PO) to the carboxylic groups [COOH] of the polycarboxylic acid (PC) is preferably 2/1 to 1/1, more preferably 1.5/1 to 1/1, further more preferably 1.3/1 to 1.02/1.

The content of the polyol (PO) in the isocyanate group containing polyester prepolymer (A) can be appropriately adjusted depending on the purpose without any restrictions. The content thereof is preferably 0.5% by mass to 40% by mass, more preferably 1% by mass to 30% by mass, further more preferably 2% by mass to 20% by mass.

In the case where the content is less than 0.5% by mass, hot-offset resistance is degreased, and thus it is difficult to attain both heat resistant stability, and low temperature fixing ability at the same time. In the case where the content is more than 40% by mass, the low temperature fixing ability is lowered.

The polyisocyanate (PIC) can be appropriately selected depending on the purpose without any restrictions. Examples thereof include aliphatic polyisocyanate, alicyclic polyisocyanate, aromatic diisocyanate, aromatic aliphatic diisocyanate, isocyanurate, phenol derivatives thereof, blocked product thereof with oxime or caprolactam.

Examples of the aliphatic polyisocyanate include tetramethylene diisocyanate, hexamethylene diisocyanate, 2,6-disocyanate methylcaproate, octamethylene diisocyanate, decamethylene diisocyanate, dodecamethylene diisocyanate, tetradecamethylene diisocyanate, trimethylhexan diisocyanate, tetramethylhexane diisocyanate, and the like. Examples of the alicyclic polyisocyanate include isophorone diisocyanate, cyclohexylmethane diisocyanate, and the like. Examples of the aromatic diisocyanate include tolylene diisocyanate, diphenylmethane diisocyanate, 1,5-nephthylene diisocyanate, diphenylene-4,4'-diisocyanate, 4,4'-diisocyanate-3,3'-dimethyldiphenyl, 3-methyldiphenylmethane-4,4'-diisocyanate, diphenylether-4,4'-diisocyanate, and the like. Examples of the aromatic aliphatic diisocyanate include a,a,a',a'-tetramethylxylene diisocyanate, and the like. Examples of the isocyanurate include tris-isocyanato-alkyl-isocyanurate, triisocyanato-cycloalkyl-isocyanurate, and the like. These can be used singly, or in combination of two or more.

At the time when the polyisocyanate (PIC) and the active hydrogen group containing polyester (e.g. hydroxyl group containing polyester) are subjected to a reaction, the mixing ratio thereof can be appropriately adjusted depending on the purpose without any restrictions. For example, an equivalent ratio ([NCO]/[OH]) of the isocyanate groups [NCO] in the polyisocyanate (PIC) to the hydroxyl groups [OH] of the hydroxyl group containing polyester is preferably 5/1 to 1/1, more preferably 4/1 to 1.2/1, further more preferably 3/1 to 1.5/1.

In the case where a ratio of the isocyanate groups [NCO] is more than 5, the low temperature fixing ability may be degraded. IN the case where a ratio of the isocyanate groups [NCO] is less than 1, the hot-offset resistance may be degraded.

The content of the polyisocyanate (PIC) in the isocyanate group containing polyester prepolymer (A) can be appropriately adjusted depending on the purpose without any restrictions. The content thereof is preferably 0.5% by mass to 40% by mass, more preferably 1% by mass to 30% by mass, further more preferably 2% by mass to 20% by mass.

In the case where the content is less than 0.5% by mass, hot-offset resistance is degreased, and thus it is difficult to attain both heat resistant stability, and low temperature fixing ability at the same time. In the case where the content is more than 40% by mass, the low temperature fixing ability is degraded.

The average number of isocyanate groups per molecule of the isocyanate group containing polyester prepolymer is preferably 1 or more, more preferably 1.2 to 5, further more preferably 1.5 to 4.

In the case where the average number of insocyanate groups per molecule is less than 1, the molecular weight of the reactive modified polyester (RMPE) with the urea bonding generating groups becomes low, and thus the hot-offset resistance may be degraded.

The weight average molecular weight (Mw) of the polymer reactive with an active hydrogen group containing compound is preferably 1,000 to 30,000, more preferably 1,500 to 15,000 in terms of a molecular weight distribution of tetrahydrofuran (THF) soluble components obtained by gel permeation chromatography (GPC).

In the case where the weight average molecular weight (Mw) is less than 1,000, the heat resistant stability may be degraded. In the case where it is more than 30,000, the low temperature fixing ability may be degraded.

The determination of the molecular weight distribution according to gel permeation chromatography (GPC) can be carried out, for example, in the following manner.

A column is placed and stabilized in a heat chamber at 40° C., THF as an eluent is fed at a flow rate of 1 ml/min to the column at the same temperature, and 50-200 μl of a resin sample THF solution in which the concentration of the sample is controlled at 0.05% by mass to 0.6% by mass is injected into the column to thereby carry out the determination. The molecular weight of the sample is determined by calculation based on the logarithm of calibration curve prepared by using monodispersed polystyrene reference samples. As the monodispersed polystyrene reference samples, for example, at least about ten polystyrene reference samples, those having a molecular weight of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$, available from Pressure Chemical Co., or Tosoh Corporation, can be used. A refractive index (RI) detector can be used as the detector.

—Binder Resin—

The binder resin is appropriately selected depending on the purpose, without any restrictions. The binder resin is, for example, polyester, and the like. Particularly, non-modified polyester (polyester which is not modified) is preferable as the binder resin.

If the non-modified polyester is contained in the toner, the toner can improve its low temperature fixing ability and glossiness.

Examples of the non-modified polyester include the one equivalent to the aforementioned polyester having groups which generate urea bonding, i.e. a polycondensation product of polyol (PO) and polycarboxylic acid (PC), and the like. It is preferred that the non-modified polyester is partially compatible with the polyester having groups which generate urea bonding, namely having the similar structure which allow them to be compatible to each other, in view of the low temperature fixing ability and hot-offset resistance.

The weight average molecular weight (Mw) of the non-modified polyester is preferably 1,000 to 30,000, more preferably 1,500 to 15,000 in terms of a molecular weight distribution of tetrahydrofuran (THF) soluble components obtained by gel permeation chromatography (GPC).

In the case where the weight average molecular weight (Mw) is less than 1,000, the heat resistant stability may be degraded. Therefore, the content of the component having the weight average molecular weight (Mw) of less than 1,000 needs to be in the range of 8% by mass to 28% by mass. In the case where it is more than 30,000, the low temperature fixing ability may be degraded.

The glass transition temperature of the non-modified polyester is preferably 35° C. to 65° C., more preferably 35° C. to 50° C. In the case where the glass transition temperature thereof is lower than 35° C., the heat resistant stability of the toner may be degraded. In the case where the glass transition temperature thereof is higher than 65° C., the low temperature fixing ability of the toner may be insufficient.

The hydroxyl value of the non-modified polyester is preferably 5 mg KOH/g or more, more preferably 10 mg KOH/g to 120 mg KOH/g, further preferably 20 mg KOH/g to 80 mg KOH/g. In the case where the hydroxyl value thereof is less than 5 mg KOH/g, it is difficult to attain both the heat resistant stability and the low temperature fixing ability at the same time.

The acid value of the non-modified polyester is preferably 1.0 mg KOH/g to 50.0 mg KOH/g, more preferably 1.0 mg KOH/g to 45.0 mg KOH/g, further preferably 15.0 mg KOH/g to 45.0 mg KOH/g. The toner tends to be negatively charged when the toner has such the acid value.

The hydroxyl value and the acid value are specifically determined in the following manner.

Measuring device: Automatic potentiometric titrator, DL-53 Titrator, manufactured by Mettler-Toledo International Inc.

Electrode for use: DG113-SC, manufactured by Mettler-Toledo International Inc.

Software for analysis: LabX Light Version 1.00.000

Calibration for the device: Using a mixed solvent of 120 ml toluene and 30 ml ethanol Measuring temperature: 23° C.

The conditions for the measurements are as follows:

Stir
- Speed [%]: 25
- Time[s]: 15

EQP titration
- Titrant/Sensor
- Titrant: $CH_3ONa$
- Concentration [mol/L]: 0.1
- Sensor: DG115
- Unit of measurement: mV
- Predispensing to volume
- Volume [mL]: 1.0
- Wait time [s]: 0
- Titrant addition Dynamic
- dE(set) [mV]: 8.0
- dV(min) [mL]: 0.03
- dV(max) [mL]: 0.5
- Measure mode Equilibrium controlled
- dE [mV]: 0.5
- dt [s]: 1.0
- t(min) [s]: 2.0
- t(max) [s]: 20.0
- Recognition
- Threshold: 100.0
- Steepest jump only: No
- Range: No
- Tendency: None
- Termination
- At maximum volume [mL]: 10.0
- At potential: No
- At slope: No
- After number EQPs: Yes
- n=1 comb. Termination conditions: No
Evaluation
Procedure Standard
Potential 1: No
Potential 2: No
Stop for reevaluation: No -Measuring Method of Acid Value- The acid value can be measured in accordance with a measuring method specified in JIS K0070-1992, in the following conditions.

A sample is prepared by adding 0.5 g of the toner (0.3 of ethyl acetate soluble component) to 120 ml of toluene, stirring at 23° C. for about 10 hours so as to dissolve the toner, and further adding 30 ml of ethanol to the mixture to thereby yield a sample solution.

The measurement can be determined by calculations conducted by means of the aforementioned device. Specifically, the calculations are conducted in the following manner.

The titration is conducted with N/10 potassium hydroxide alcohol solution which has been previously standardized, and the acid value is determined by the following calculation based on the consumption of the potassium hydroxide alcohol solution.

Acid value=KOH (mol number)×N×56.1/mass of the sample (Note: N Denotes a Factor of N/10 KOH)

The hydroxyl value can be measured in accordance with a measuring method specified in JIS K0070-1966, in the following conditions.

0.5 g of a sample is precisely weighted in a 100 ml volumetric flask, and 5 ml of an acetylation reagent is added thereto. Thereafter, the mixture is heated by immersing the flask in a hot bath at the temperature of 100° C.±5° C. One to two hours later, the flask is removed from the bath, is left to stand to cool. The mixture is then added with water, and is oscillated to thereby decompose acetic anhydride. In order to complete the decomposition, the flask is again immersed in the hot bath to heat the mixture for more than 10 minutes, the mixture is then left to stand to cool, and the wall of the flask is washed well with an organic solvent. The potentiometric titration is conducted on this mixed solution using N/2 potassium hydroxide ethyl alcohol solution by means of the aforementioned electrode, to thereby determine a hydroxyl value.

When the non-modified polyester is contained the toner, a mixing mass ratio of the polyester having groups which generate urea bonding (RMPE) to the non-modified polyester (PE) is preferably 5/95 to 20/80, more preferably 10/90 to 25/75.

In the case where the mixing mass ratio of the non-modified polyester (PE) is more than 95, the hot-offset resistance becomes deteriorated, and it may be difficult to attain both the heat resistant stability and the low temperature fixing ability. In the case where the mixing mass ratio of the non-modified polyester (PE) is less than 20, the glossiness of the resulted images may be lowered.

The content of the non-modified polyester (PE) in the binder resin is preferably 50% by mass to 100% by mass, more preferably 70% by mass to 95% by mass, further preferably 80% by mass to 90% by mass. In the case where the content is less than 50% by mass, the low temperature fixing ability and the glossiness of the resulted images may be lowered.

-Other Components-

The other components of the toner are appropriately selected depending on the purpose, without any restrictions. Examples thereof include a coloring agent, a releasing agent, a charge controlling agent, inorganic fine particles, a fluidity improving agent, a cleaning improving agent, a magnetic material, a metal soap, and the like.

The coloring agent is appropriately selected depending on the purpose without any restrictions. Examples of the coloring agent include carbon black, Nigrosine dye, black iron oxide, Naphthol Yellow S, Hansa Yellow (10G, 5G, and G), Cadmium Yellow, yellow iron oxide, yellow ocher, chrome yellow, Titanium Yellow, polyazo yellow, Oil Yellow, Hansa Yellow (GR, A, RN, and R), Pigment Yellow L, Benzidine Yellow (G, and GR), Permanent Yellow (NCG), Vulcan Fast Yellow (5G, and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS, and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachitge Green Lake, Phthalocyanine Green, Anhraquinone Green, titanium oxide, zinc oxide, lithopone, and the like. These may be used singly, or in combination of two or more.

The content of the coloring agent in the toner can be appropriately adjusted depending on the purpose, without any restrictions. The content of the coloring agent is preferably 1% by mass to 15% by mass, more preferably 3% by mass to 10% by mass.

In the case where the content thereof is less than 1% by mass, the coloring ability of the toner may be lowered. In the case where the content thereof is more than 15% by mass, the pigment may not be defectively dispersed in the toner, the coloring ability of the toner may be lowered, and the electric characteristics of the toner may be deteriorated.

The coloring agent can be used as a master batch in which the coloring agent is combined with a resin. The resin for use can be appropriately selected from known resins depending on the purpose, without any restrictions. Examples thereof include styrene or substituted styrene polymer, copolymer of styrene, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, acrylic resin, rosin, modified rosin, terpene resin, aliphatic hydrocarbon resin, alicyclic hydrocarbon resin, aromatic petroleum resin, chlorinated paraffin, paraffin wax, and the like. These can be used singly, or in combination of two or more.

Examples of the styrene or substituted styrene polymer include polyester, polystyrene, poly-p-chlorostyrene, polyvinyl toluene, and the like. Examples of the copolymer of styrene include styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic ester copolymer, and the like.

The master batch is prepared by mixing or kneading the resin for the master batch and the coloring agent with higher shear force. In the course of this process, it is preferred that an organic solvent is added to the mixture so as to increase interaction between the coloring agent and the resin. Moreover, a flashing method is preferable in view of that a wet cake of the coloring agent can be used as it is, and no drying procedure is necessary.

The flashing method is a method wherein an aqueous past containing the coloring agent and water is mixed or kneaded with the resin and the organic solvent so as to transfer the coloring agent into the resin, and then the water and organic solvent are removed therefrom. The mixing or kneading is preferably performed by means of a high-shear dispersing device, such as a three-roller mill.

The releasing agent can be appropriately selected from the conventional ones depending on the purpose, without any restrictions. Examples thereof include wax, and the like.

Specific examples of the wax include wax containing carbonyl groups, polyolefin wax, long-chain hydrocarbon, and the like. These can be used singly, or in combination of two or more. Among these, the wax containing carbonyl groups is preferable.

Examples of the wax containing carbonyl groups include polyalkanoic acid ester, polyalkanol ester, polyalkylamide, dialkyl keone, and the like. Examples of polyalkanoic acid ester include carnauba wax, montan wax, trimethylolpropane tribehenate, pentaerythritol tetrabehenate, pentaerythritol diacetate dibehenate, glycerin tribehenate, and 1,18-octadecanediol distearate. Examples of polyalkanol ester include tristearyl trimellitate, and distearyl maleate. Examples of polyalkanoic acid amide include ethylenediamine dibehenylamide. Examples of dialkyl ketone include distearyl ketone. Among these, polyalkanoic acid ester is particularly preferable.

Examples of the polyolefin wax include polyethylene wax, polypropylene wax, and the like.

Examples of the long-chain hydrocarbon include paraffin wax, SASOL wax, and the like.

The melting point of the releasing agent is appropriately adjusted depending on the intended purpose, without any restrictions. The melting point of the releasing agent is preferably 40° C. to 160° C., more preferably 50° C. to 120° C., most preferably 60° C. to 90° C.

In the case where the melting point of the releasing agent is lower than 40° C., the heat resistant stability of the wax may be reduced. In the case where the melting point of the releasing agent is higher than 160° C., it is likely that cold offset may occur during a low-temperature fixing process.

The melt viscosity of the releasing agent is preferably 5 cps to 1,000 cps, more preferably 10 cps to 100 cps at a temperature which 20° C. higher than the melting point of the releasing agent.

The content of the releasing agent is appropriately adjusted depending on the purpose without any restrictions. It is preferably 40% by mass or less, more preferably 3% by mass to 30% by mass. In the case where the content thereof is more than 40% by mass, the flowability of the toner may be lowered.

The charge controlling agent is appropriately selected from those known in the art depending on the purpose, without any restrictions. However, if a colored material is selected as a charge controlling agent, a toner containing such the charge controlling agent may change its tone. Therefore, colorless materials or materials having a color close to white are preferable. Examples thereof include a triphenylmethane dye, a molybdic acid chelate pigment, a rhodamine dye, alkoxy amine, a quaternary ammonium salt (including fluoride-modified quaternary ammonium salt), alkylamide, phosphous or a compound thereof, tungsten or a compound thereof, a fluoride activator, a metal salt of salicylic acid, and a metal salt of a salicylic acid derivative. These may be used singly or in combination of two or more.

For the charge controlling agent, commercially available products may be used. Examples thereof include: Bontron P-51 which is a quaternary ammonium salt, Bontron E-82 which is an oxynaphthoic acid metal complex, Bontron E-84 which is a salicylic acid metal complex, and Bontron E-89 which is a phenol condensate (manufactured by Orient Chemical Industries, Ltd.); TP-302 and TP-415, both are a quaternary ammonium salt molybdenum metal complex (manufactured by Hodogaya Chemical Co.); Copy Charge PSY VP2038 which is a quaternary ammonium salt, Copy Blue PR which is a triphenylmethane derivative, and Copy Charge NEG VP2036 and Copy Charge NX VP434, both of which are a quaternary ammonium salt (manufactured by Hoechst Ltd.); LRA-901 and LR-147 which are boron metal complexs (manufactured by Japan Carlit Co., Ltd.); quinacridones; azo pigments; high-molecular weight compounds bearing a functional group (e.g., sulfonic group and carboxyl group); and the like.

The charge controlling agent can be added to the toner, for example, by kneading and melting together with a master batch and the dissolving and dispersing the master batch containing the charge controlling agent in the organic solvent, by directly adding to the organic solvent together with other components of the toner at the time when the toner components are dissolvent and/or dispersed in the organic solvent, or by adding and fixing to a surface of the toner after toner particles are formed.

The content of the charge controlling agent in the toner is appropriately adjusted depending on the binder resin for use, the existence of the external additives, a method for dispersing, and the like. However, the content thereof is preferably 0.1 parts by mass to 10 parts by mass, more preferably 0.2 parts by mass to 5 parts by mass, with respect to 100 parts by mass of the binder resin. In the case where the content is less than 0.1 parts by mass, the charge controlling performances may not be attained. In the case where the content is more than 10 parts by mass, charging properties of toner becomes exceedingly enhanced, reducing the effect of the charge controlling agent primarily used, and an electrostatic suction force that presses toner against developing rollers increases. Thus, it may cause reduction in the flowability of the developer and/or in image density.

-Resin Particles-

The resin particles can be appropriately selected from conventional resins depending on the intended purpose, without any restrictions, provided that the resin can form aqueous dispersion in an aqueous medium. The resin forming the resin particles can be either of thermoplastic or of thermoset. Examples thereof include a vinyl resin, a polyurethane resin, an epoxy resins, a polyester resin, a polyamide resin, a polyimide resin, a silicone resin, a phenol resin, a melamine resin, a urea resin, an aniline resin, an ionomer resin, a polycarbonate resin, and the like. Among these, the vinyl resin is particularly preferable.

These can be used singly, or in combination of two or more. Among these, the resin particles are preferably formed from at least one resin selected from the vinyl resin, the polyurethane resin, the epoxy resin, and the polyester resin, in view of that it is easy to obtain aqueous dispersion of fine spherical resin particles.

Note that, the vinyl resin is a polymer wherein vinyl monomers are homopolymerized, or copolymerized. Examples thereof include a styrene-(meth)acrylate resin, styrene-butadiene copolymer, (meth)acrylic acid-acrylic acid ester polymer, styrene-acrylonitrile copolymer, styrene-maleic anhydride copolymer, styrene-(meth)acrylic acid copolymer, and the like.

The copolymer containing a monomer including at least two unsaturated groups can be also used as a material for forming the resin particles.

The monomer including at least two unsaturated groups can be appropriately selected depending on the purpose without any restrictions. Examples thereof include ethyleneoxide methacrylate adduct of sodium sulphate (ELEMINOL RS-30, manufactured by Sanyo Chemical Industries, Ltd.), divinyl benzene, 1,6-hexanediol acrylate, and the like.

The resin particles can be prepared by polymerizing in accordance with the conventional method appropriately selected depending on the purpose. Preferably, the resin particles are obtained as an aqueous dispersion of resin particles. Examples of the preparation method of the aqueous dispersion of the resin particles include the following methods (1)-(8):

(1) In the case where the resin is the vinyl resin, an aqueous dispersion of resin particles is directly prepared by a polymerization reaction selected from a suspension-polymerization method, an emulsification-polymerization method, a seed polymerization method, and a dispersion polymerization method, using a vinyl monomer as a starting material.

(2) In the case where the resin is a polyaddition and/or condensation resin such as the polyester resin, the polyurethane resin, the epoxy resin, and the like, an aqueous dispersion of resin particles is prepared by dispersing a precursor (monomer, oligomer, or the like) or its solution in an aqueous medium under the presence of an appropriate dispersant, and then heating the aqueous medium, or adding a curing agent so as to cure the resin particles.

(3) In the case where the resin is a polyaddition and/or condensation resin such as the polyester resin, the polyurethane resin, the epoxy resin, and the like, an aqueous dispersion of resin particles is prepared by dissolving an appropriate emulsifier in a precursor (monomer, oligomer, or the like) or its solution (which is preferably liquid, or alternatively becomes liquid when heated), and adding water thereto so as to proceed phase reversal emulsification.

(4) An aqueous dispersion of resin particles is prepared by pulverizing a resin which has been previously prepared by a polymerization reaction (which can be any polymerization system such as addition polymerization, ring-opening polymerization, polyaddition, addition condensation, condensation polymerization, and the like) by means of a mechanical rotating type or jet type pulverizer, classifying the pulverized resin so as to obtain resin particles, and dispersing resin particles in water under the presence of an appropriate dispersant.

(5) An aqueous dispersion of resin particles is prepared by dissolving a resin which has been previously prepared by a polymerization reaction (which can be any polymerization system such as addition polymerization, ring-opening polymerization, polyaddition, addition condensation, condensation polymerization, and the like) in a solvent so as to prepare a resin solution, atomizing the resin solution in the state of mist so as to obtain resin particles, and dispersing the resin particles in water under the presence of an appropriate dispersant.

(6) An aqueous dispersion of resin particles is prepared by dissolving a resin which has been previously prepared by a polymerization reaction (which can be any polymerization system such as addition polymerization, ring-opening polymerization, polyaddition, addition condensation, condensation polymerization, and the like) in a solvent so as to prepare a resin solution, adding a poor solvent thereto so as to precipitate resin particles, or alternatively precipitating resin particles by dissolving the resin in a heated solvent to prepare a resin solution and the cooling the resin solution, sequentially removing the solvent from the resin particles to obtain the resin particles, and the dispersing the resin particles in water under the presence of an appropriate dispersant.

(7) An aqueous dispersion of resin particles is prepared by dissolving a resin which has been previously prepared by a polymerization reaction (which can be any polymerization system such as addition polymerization, ring-opening polymerization, polyaddition, addition condensation, condensation polymerization, and the like) in a solvent so as to prepare a resin solution, dispersing the resin solution in an aqueous medium under the presence of an appropriate dispersant, and then removing the solvent by heating or reducing the pressure.

(8) An aqueous dispersion of resin particles is prepared by dissolving a resin which has been previously prepared by a polymerization reaction (which can be any polymerization system such as addition polymerization, ring-opening polymerization, polyaddition, addition condensation, condensation polymerization, and the like) in a solvent so as to prepare a resin solution, dissolving an appropriate emulsifier in the resin solution, and adding water thereto so as to proceed a phase interval emulsification.

The inorganic particles can be appropriately selected from known particles depending on the purpose, without any restrictions. Examples thereof include silica, aluminum, titanium oxide, barium titanate, magnesium titanate, calcium titanate, strontium titanate, zinc oxide, tin oxide, quartz sand, clay, mica, sand-lime, diatomearth, chromiumoxide, cerium oxide, red iron oxide, antimony trioxide, magnesium oxide, zirconium oxide, barium sulfate, barium carbonate, calcium carbonate, silicon carbide, silicon nitrate, and the like. These can be used singly, or in combination of two or more.

The inorganic particles have a primary particle diameter of preferably 5 nm to 2 μm, more preferably 5 nm to 500 nm. Moreover, the inorganic particles have a BET specific surface area of preferably 20 $m^2/g$ to 500 $m^2/g$.

The content of inorganic particles in the toner is preferably 0.01% by mass to 5.0% by mass.

A flowability improver is an agent that improves hydrophobic properties of resin particles through surface treatment, and is capable of preventing reduction of the flowability and/or charging ability of resin particles even when exposed to high humidity environment. Examples thereof include a silane coupling agent, a sililating agent, a silane coupling agent bearing a fluorinated alkyl group, an organotitanate coupling agent, an aluminum-based coupling agent, silicone oil, modified silicone oil, and the like.

A cleaning improver is added to the resin particles to remove a developer remaining on a photoconductor and/or on a primary transferring member after a transferring step. Examples thereof include zinc stearate, calcium stearate, stearic acid, and polymer particles prepared by soap-free emulsion polymerization such as polymethylmethacrylate particles and polyethylene particles. Among these, polymer particles with a relatively narrow particle size distribution are preferable, and polymer particles with a volume-average particle diameter of 0.01 μm to 1 μm are more preferable.

The magnetic material can be appropriately selected from those known in the art depending on the purpose, without any restrictions. Examples thereof include iron powder, magnetite, ferrite, and the like. Among these, those having a color of white are preferable in view of the tone of the toner.

Examples of the toner include those prepared by a conventional suspension-polymerization method, emulsification aggregation method, emulsification dispersion method, and the like. The preferable example of the toner is the one which is prepared by dissolving the toner material containing the active hydrogen group containing compound, and the polymer reactive with the active hydrogen group containing compound in an organic solvent so as to prepare a toner solution, dispersing the toner solution in an aqueous medium so as to prepare a dispersion, allowing the active hydrogen group containing compound and the polymer reactive with the active hydrogen group containing compound to react in the aqueous medium so as to generate the adhesive base in the form of particles, and removing the solvent therefrom.

-Toner Solution-

The toner solution is prepared by dissolving the toner material in the organic solvent.

-Organic Solvent-

The organic solvent can be appropriately selected depending on the purpose without any restrictions, provided that it is capable of dissolving and/or dispersing the toner material therein. For example, the organic solvent is preferably a volatile organic solvent having a boiling point of less than 150° C. in view of the easiness of the treatment for removing the organic solvent. Examples thereof include toluene, xylene, benzene, carbon tetrachloride, methylene chloride, 1,2-dichloroethane, 1,1,2-trichloroethane, chloroethylene, chloroform, monochlorobenzene, dichloroethylidene, methyl acetate, ethyl acetate, methylethyl ketone, methylisobutyl ketone, and the like. Among these, toluene, xylene, benzene, methylene chloride, 1,2-dichloroethane, chloroform, carbon tetrachloride, and the like are preferable, and ethyl acetate is particularly preferable. These can be used singly, or in combination of two or more.

The usage amount of the organic solvent can be appropriately adjusted depending on the purpose without any restrictions. For example, the amount thereof is preferably 40 parts by mass to 300 parts by mass, more preferably 60 parts by mass to 140 parts by mass, further more preferably 80 parts by mass to 120 parts by mass, with respect to 100 parts by mass of the toner material.

-Dispersion-

The dispersion is prepared by dispersing the toner solution in the aqueous medium. At the time when the toner solution is dispersed in the aqueous medium, dispersion elements (oil droplets) formed of the toner solution are formed in the aqueous medium.

-Aqueous Medium-

The aqueous medium can be appropriately selected from those known in the art without any restrictions. Examples thereof include water, a solvent mixable with water, the mixture thereof, and the like. Among these, water is particularly preferable.

The solvent mixable with water is appropriately selected provided that it is mixable with water. Examples thereof include alcohol, dimethylformamide, tetrahydrofuran, cellosolve, lower ketone, and the like.

Specific examples of the alcohol include methanol, isopropanol, ethylene glycol, and the like. Specific examples of the lower ketone include acetone, methylethyl ketone, and the like.

These can be used singly, or in combination of two or more.

It is preferred that the toner solution is dispersed in the aqueous medium while being stirred.

The method of stirring can be appropriately selected using the conventional disperser or the like, without any restrictions. Examples of the disperser include a low-speed shear disperser, a high-speed shear disperse, a friction disperser, a high-pressure jet disperser, an ultrasonic disperser, and the like. Among these, the high-speed shear disperser is preferable in view of that the particle diameter of the dispersing elements (oil droplets) can be controlled within the range of 2 μm to 20 μm.

In the case where the high-speed shear disperser is used, the conditions such as a revolution, dispersion duration, dispersion temperature and the like are appropriately adjusted depending on the purpose without any restrictions. The revolution is preferably 1,000 rpm to 30,000 rpm, more preferably 5,000 rpm to 20,000 rpm. The dispersion duration is preferably 0.1 minutes to 5 minutes in the case of the master batch. The dispersion temperature is preferably 0° C. to 150° C., more preferably 40° C. to 98° C. under pressure. Note that, the higher dispersion temperature is generally easier to proceed the dispersion.

As an example of a manufacturing method of the toner, a method for obtaining a toner by generating the adhesive base in the shape of particles is explained hereinafter.

In the method for obtaining the toner by generating the adhesive base in the shape of particles, for example, a preparation of an aqueous medium phase, a preparation of the toner solution, a preparation of the dispersion, an addition of the aqueous medium, and other preparations (a synthesis of the polymer (prepolymer) reactive with the active hydrogen group containing compound, a synthesis of the active hydrogen group containing compound, and the like) are performed.

The aqueous medium phase is prepared, for example, by dispersing the resin particles in the aqueous medium. The content of the resin particles in the aqueous medium can be appropriately adjusted depending on the purpose without any restrictions. For example, the content thereof is preferably 0.5% by mass to 10% by mass.

The toner solution is prepared by dissolving and/or dispersing the toner material containing the active hydrogen group containing compound, the polymer reactive with the active hydrogen group containing compound, the colorant, the releasing agent, the charge controlling agent, the non-modified polyester, and the like, in the organic solvent.

In the process of preparing the aqueous medium phase, the components of the toner material other than the active hydrogen group containing compound and the polymer (prepolymer) reactive with the active hydrogen group containing compound can be added to the aqueous medium at the time when the resin particles are dispersed in the aqueous medium, or alternatively added to the aqueous medium phase together with the toner solution at the time when the toner solution is added to the aqueous medium phase.

The dispersion is prepared by emulsifying and/or dispersing the toner solution which has been previously prepared, in the aqueous medium phase which has also been previously prepared. At the time of emulsifying and/or dispersing, the adhesive base is generated as a result of the elongation reaction and/or crosslinking reaction between the active hydrogen group containing compound and the polymer reactive with the active hydrogen group containing compound.

The adhesive base (e.g. urea-modified polyester) is generated, for example, by the following manners (1)-(3):

(1) The toner solution containing the polymer reactive with the active hydrogen group containing compound (e.g. the isocyanate group containing polyester prepolymer) is emulsified and/or dispersed in the aqueous medium phase together with the active hydrogen group containing compound (e.g. the amine (B)) so as to form dispersing elements, and these two compounds are allowed to proceed the elongation reaction and/or crosslinking reaction in the aqueous medium phase to thereby generate the adhesive base.

(2) The toner solution is emulsified and/or dispersed in the aqueous medium, which has been previously added with the active hydrogen group containing compound, so as to form dispersing elements, and these two compounds are allow to proceed the elongation reaction and/or crosslinking reaction in the aqueous medium phase to thereby generate the adhesive base.

(3) The toner solution is added and mixed in the aqueous medium, the active hydrogen group containing compound is added thereto so as to form dispersing elements, and these two compounds are allow to proceed the elongation reaction and/or crosslinking reaction from the surfaces of the particles in the aqueous medium phase to thereby generate the adhesive base.

Note that, in the case of (3), the modified polyester is preferentially generated at the surface of the toner to be generated, and thus the concentration gradation of the modified polyester can be provided within the toner particles.

The reaction conditions for generating the adhesive base by the emulsification and/or dispersion are appropriately adjusted depending on the combination of the active hydrogen group containing compound and the polymer reactive with the active hydrogen group containing compound, without any restrictions. The reaction duration is preferably 10 minutes to 40 hours, more preferably 2 hours to 24 hours. The reaction temperature is preferably 0° C. to 150° C., more preferably 40° C. to 98° C.

The method for stably forming the dispersing elements containing the active hydrogen group containing compound and the polymer reactive with the active hydrogen group containing compound (e.g. the isocyanate group containing polyester prepolymer) in the aqueous medium phase is such that the toner solution, which is prepared by dissolving and/or dispersing the toner material containing the polymer reactive with the active hydrogen group containing compound (e.g. the isocyanate group containing polyester prepolymer), the coloring agent, the releasing agent, the charge controlling agent, the non-modified polyester, and the like, is added into the aqueous medium phase, and it is dispersed by shearing force. Note that, the specific methods for dispersing are the same as mentioned above.

In the process of preparing the dispersion, a dispersant is preferably used, if necessary, in view that the dispersing elements (the oil droplets formed of the toner solution) are stabilized and the particle size distribution having a predetermined shape is sharpened.

The dispersant is appropriately selected depending on the purpose without any restrictions. Examples thereof include a surfactant, an inorganic dispersant which has poor solubility to water, high polymer protective colloid, and the like. These can be used singly, or in combination of two or more. Among these, the surfactant is preferable.

Examples of the surfactant include an anionic surfactant, a cationic surfactant, a nonionic surfactant, an amphoteric surfactant, and the like.

Examples of the anionic surfactant include alkylbenzene sulfonate, α-olefin sulfonate, phosphoric ester, an anionic surfactant having a fluoroalkyl group, and the like. Among these, the surfactant having a fluoroalkyl group is preferable. Examples of the anionic surfactant having a fluoroalkyl group include C2-10 fluoroalkyl carboxylic acid and a metal salt thereof, disodium perfluorooctanedukfonylglutamate, sodium 3-{omega-fluoroalkyl(C6-11)oxy}-1-alkyl(C3-4) sulfonate, sodium 3-{omega-fluoroalkanoyl(C6-8)-N-ethylamino}-1-propanesulfonate, fluoroalkyl(C11-20) carboxylic acid and a metal salt thereof, perfluoroalkyl carboxylic acid and a metal salt thereof, perfluoroalkyl(C4-12) sulfonate and a metal salt thereof, perfluorooctanesulfonic acid diethanol amide, N-propyl-N-(2-hydroxyethyl)perfluorooctanesulfone amide, perfluoroalkyl(C6-10)sulfoneamide propyltrimethyl ammonium salt, salt of perfluoroalkyl(C6-10)-N-ethylsulfonyl glycin, monoperfluoroalkyl(C6-16) ethylenephosphate, and the like. Examples of the commercially available product of the anionic surfactant having a fluoroalkyl group include: SURFLON S-111, S-112 and S-113 (manufactured by Asahi Glass Co., Ltd.); FRORARD FC-93, FC-95, FC-98, and FC-129 (manufactured by Sumitomo 3M Ltd.); UNIDYNE DS-101, and DS-102 (manufactured by Daikin Industries, Ltd.); MEGAFAC F-110, F120, F-113, F-191, F-812 and F-833 (manufactured by Dainippon Ink and Chemicals, Inc.); ECTOP EF-102, 103, 104, 105, 112, 123a, 306a, 501, 201 and 204 (manufactured by Tohchem Products Co., Ltd.); FUTARGENT F-100 and F-150 (manufactured by Neos); and the like.

Examples of the cationic surfactant include an amine salt surfactant, a quaternary ammonium salt cationic surfactant, a cationic surfactant having a fluoroalkyl group, and the like. Examples of the amine salt surfactant include alkyl amine salt, amino alcohol fatty acid derivative, polyamine fatty acid derivative, imidazoline, and the like. Examples of the quaternary ammonium salt cationic surfactant include alkyltrimethyl ammonium salt, dialkyldimethyl ammonium salt, alkyldimethylbenzyl ammonium salt, pyridinium salt, alkylisoquinolium salt, benzetonium chloride, and the like. Examples of the cationic surfactant having a fluoroalkyl group include primary, secondary or tertiary aliphatic amine having a fluoroalkyl group, aliphatic quaternary ammonium salt such as perfluoroalkyl(C6-10)sulfoneamidepropyltrimethyl ammonium salt, benzalkonium salt, benzetonium chloride, pyridinium salt, imidazoline salt, and the like. Examples of the commercially available product of the cationic surfactant include: SURFLON S-121 (manufactured by Asahi Glass Co., Ltd.); FRORARD FC-135 (manufactured by Sumitomo 3M Ltd.); UNIDYNE DS-202 (manufactured by Daikin Industries, Ltd.); MEGAFAC F-150 and F-824 (manufactured by Dainippon Ink and Chemicals, Inc.); ECTOP EF-132 (manufactured by Tohchem Products Co., Ltd.); FUTARGENT F-300 (manufactured by Neos); and the like.

Examples of the nonionic surfactant include a fatty acid amide derivative, a polyhydric alcohol derivative, and the like.

Examples of the amphoteric surfactant include alanine, dodecyl di(aminoethyl)glycin, di(octylaminoethyl)glycin, N-alkyl-N,N-dimethylammonium betaine, and the like.

Examples of the inorganic dispersant having poor water solubility include tricalcium phosphate, calcium carbonate, titanium oxide, colloidal silica, hydroxyapatite, and the like.

Examples of the high polymer protective colloid include acid, (meth)acrylic monomer having a hydroxyl group, vinyl alcohol or ether of vinyl alcohol, ester of vinyl alcohol and a compound having a carboxyl group, an amide compound or its methylol compound, chloride, a homopolymer or copolymer having a nitrogen atom or alicyclic ring thereof, polyoxyethylene, cellulose, and the like.

Specific examples of the acid include acrylic acid, methacrylic acid, α-cyanoacrylic acid, α-cyanomethacrylic acid, itaconic acid, crotonic acid, fumaric acid, maleic acid, maleic anhydride, and the like. Examples of the (meth)acrylic monomer having a hydroxyl group include β-hydroxyethyl acrylate, β-hydroxylethyl methacrylate, β-hydroxylpropyl acrylate, β-hydroxylpropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide, N-methylolmethacrylamide, and the like. Examples of the vinyl alcohol or ether of vinyl alcohol include vinylmethyl ether, vinylethyl ether, vinylpropyl ether, and the like. Examples of the ester of vinyl alcohol and a compound having a carboxyl group include vinyl acetate, vinyl propionate, vinyl butyrate, and the like. Examples of the amide compound or methylol compound thereof include acryl amide, methacryl amide, diacetone acryl amide acid, or methylol compounds thereof. Examples of the chloride include acrylic acid chloride, methacrylic acid chloride, and the like. Examples of the homopolymer or copolymer having a nitrogen atom or alicyclic ring thereof include vinyl pyridine, vinyl pyrrolidone, vinyl imidazole, ethylene imine, and the like. Examples of the polyoxy ethylene include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, polyoxyethylene nonylphenylester, and the like. Examples of the cellulose include methyl cellulose, hydroxyethyl cellulose, hydroxypropyl cellulose, and the like.

In the process of preparing the dispersion, a dispersion stabilizer is used, if necessary.

Examples of the dispersion stabilizer include acid such as calcium phosphate, an alkali-soluble compound, and the like.

When the dispersion stabilizer is used, calcium phosphate is removed from the particles by dissolving calcium phosphate by acid such as hydrochloric acid, and then washing with water, or alternatively by decomposing calcium phosphate by using enzyme.

In the process of preparing the dispersion, a catalyst for the elongation reaction and/or crosslinking reaction can be used. Examples of the catalyst include dibutyltin laurate, dioctyltin laurate, and the like.

The organic solvent is removed from the thus obtained dispersion (emulsified slurry). The removal of the organic solvent is performed by (1) gradually elevating the temperature of the whole reaction system so a to completely evaporate and remove the organic solvent from the oil droplets, or (2) spraying the emulsified dispersion in a dry atmosphere so as to completely remove the non-water soluble organic solvent from the oil droplets to thereby form toner particles, as well as evaporating and removing the aqueous dispersant.

After removing the organic solvent, the toner particles are formed. The toner particles can be subjected to treatments such as washing, drying and the like. Thereafter, the toner particles are classified. The classification is performed, for example, by removing fine particles in the liquid using a cyclone, a decanter, or a method utilizing centrifuge. Alternatively, the classification is performed on the powder obtained after drying.

The thus obtained toner particles are mixed with particles such as the coloring agent, the releasing agent, the charge controlling agent, and the like, and mechanical impact is further imparted thereto. In this way, the particles such as the releasing agent can be prevented from falling off from the surface of the toner particle.

The method for imparting the mechanical impact is, for example, a method wherein the impact is imparted to the mixture by a blade which is rotated at high speed, a method wherein the mixture is added in a high-speed flow, the speed of the flow is further increased so as to make the particles to give impact to each other, or let the composite particles hit on the impact board, or the like. Examples of the device for use in this method include ONG MILL (manufactured by Hosokawa Micron Co., Ltd.), I TYPE MILL (manufactured by Nippon Pneumatic Mfg. Co., Ltd.), HYBRIDIZATION SYSTEM (Nara Machine Co., Ltd.), KRYPTRON SYSTEM (manufactured by Kawasaki Heavy Industries, Ltd.), an automatic mortar, and the like.

The toner preferably has such the volume average particle diameter (Dv), a ratio (Dv/Dn) of the volume average particle diameter (Dv) to the number average particle diameter (Dn), and the average circularity as described below.

The volume average particle diameter (Dv) of the toner is preferably 3 μm to 10 μm, more preferably 4 μm to 8 μm. Here, the volume average particle diameter is defined by the following formula:

$$Dv=[(\Sigma(nD^3)/\Sigma n)]^{1/3}$$

In the formula above, n denotes a number of particles, and D denotes a particle diameter.

In the case where the volume average particle diameter is less than 3 μm, in a case of two-component developer, toner may fuse to the carrier surface to reduce its charging properties as a result of a long-time agitation in a developing unit, and in a case of a one-component developer, toner filming may occur at a developing roller or toner may more likely to fuse to members (e.g., blade) because of its reduced layer thickness. In the cae where the volume average particle diameter is more than 10 μm, it becomes difficult to obtain images of high resolution and high quality, and the variations in the toner particle diameter may be large when new toner is added to the developer to compensate the consumed toner.

The ratio (Dv/Dn) of the volume average particle diameter (Dv) to the number average particle diameter (Dn) is preferably 1.00 to 1.30, more preferably 1.00 to 1.20. In the case where the ratio Dv/Dn is less than 1.00, in a case of two-component developer, toner may fuse to the carrier surface to reduce its charging properties as a result of a long-time agitation in the developing unit, and in a case of a one-component developer, toner filming may occur at the developing roller or toner may more likely to fuse to members (e.g., blades) because of its reduced layer thickness. In the case where the ratio Dv/Dn is more than 1.30, the particle diameter of individual toner particles becomes largely varied, and the behavior of the toner may not be constant at the time of developing. This causes inferior reproducibility of small dot images, and thus images of high resolution and high quality cannot be attained.

The volume average particle diameter, and the ratio (Dv/Dn) of the volume average particle diameter to the number average particle diameter can be determined, for example, by means of a particle size analyzer, Coulter Counter TA-II, manufactured by Beckmann Coulter Inc.

The average circularity is a measure obtained by dividing the circumference of a circle that has the same area as an actual projected area of a toner particle by the circumference of that toner particle, and is preferably 0.925 to 0.970, more preferably 0.945 to 0.965. Note that it is preferable that the proportion of particles having the average circularity of less than 0.925 be 15% or less.

In the case where the average circularity is less than 0.925, it may result in poor transfer properties and toner dust-free high quality images may not be obtained. In the case where the average circularity is more than 0.970, it becomes likely that cleaning failures occur on the photoconductor and transfer belt in an image-forming system equipped with a cleaning blade, causing smears on images. For example, in a case of formation of an image that occupies a large area of a sheet (e.g., photographic images), background smears may occur because, when paper feed failure or the like occurs, toner particles that have been used to develop the image remains unremoved and accumulates on the photoconductor, or, in that case, a charging roller which provides charges to the photoconductor becomes soiled by residual toner particles and thus its original charging ability may be impaired.

The average circularity can be measured by passing a suspension containing the toner through the detection zone of the scanning unit on a plate, optically detecting the image of the particles by a CCD camera, and analyzing the image, in accordance with a method of optical detection zone. For example, the average circularity can be measured by means of a flow particle image analyzer (e.g., FPIA-2100, Sysmex Corp.)

The coloring of the toner can be appropriately selected depending on the purpose, without any restrictions. For example, it is at least one selected from a black toner, a cyan toner, a magenta toner, and a yellow toner, and each color of the toners can be obtained by appropriately selecting the type of the coloring agent. The toner is preferably a color toner.

(Developer)

The developer of the present invention contains at least the toner of the present invention, and further contains appropriately selected other substances, such as carrier. The developer is either a one-component developer or a two-component developer. When it is applied to high-speed printers that support increasing information processing rates of recent years, a two-component developer is preferable in view of achieving an excellent shelf life.

In the case of a one-component developer containing the toner of the present invention, the variations in the toner particle diameter are minimized even after consumption or addition of toner, and toner filming to a developing roller and toner adhesion to members (e.g., blade) due to its reduced layer thickness are prevented. Thus, it is possible to provide excellent and stable developing properties and images even after a long time usage of the developing unit (i.e., after long time agitation of developer). Meanwhile, in the case of a two-component developer containing the toner of the present invention, even after many cycles of consumption and addition of toner, the variations in the toner particle diameter are minimized and, even after a long time agitation of the developer in the developing unit, excellent and stable developing properties may be obtained.

-Carrier-

The carrier can be appropriately selected depending on the purpose without any restrictions. The carrier is preferably selected from those having a core material and a resin layer coating the core material.

The core material is appropriately selected from those know in the art, without any restrictions. For example, materials based on manganese-strontium (Mn—Sr) of 50 emu/g to 90 emu/g and materials based on manganese-magnesium (Mn—Mg) are preferable. From the standpoint of securing image density, high magnetizing materials such as iron powder (100 emu/g or more) and magnetite (75 emu/g to 120 emu/g) are preferable. In addition, weak magnetizing materials such as copper-zinc (Cu—Zn)-based materials (30 emu/g to 80 emu/g) are preferable from the standpoint for achieving higher-grade images by reducing the contact pressure against the photoconductor having standing toner particles. These materials may be used singly or in combination.

The particle diameter of the core material, in terms of volume-average particle diameter, is preferably 10 μm to 150 μm, more preferably 40 μm to 100 μm. If the average particle diameter (volume average particle diameter ($D_{50}$)) is less than 10 μm, fine particles make up a large proportion of the carrier particle distribution, causing carrier splash due to reduced magnetization per one particle in some cases; on the other hand, if it exceeds 150 μm, the specific surface area of the particle decreases, causing toner splashes and reducing the reproducibility of images, particularly the reproducibility of solid-fills in full-color images.

The material of the resin layer is appropriately selected from those known in the art, without any restrictions. Examples thereof include an amino resin, a polyvinyl resin, a polystyrene resin, a halogenated olefin resin, a polyester resin, a polycarbonate resin, a polyethylene resin, a polyvinyl fluoride resin, a polyvinylidene fluoride resin, a polytrifluoroethylene resin, a polyhexafluoropropylene resin, a copolymer of vinylidene fluoride and acrylic monomers, a copolymer of vinylidene fluoride and vinyl fluoride, fluoroterpolymer such as terpolymer of tetrafluoroethylene, vinylidene fluoride and non-fluoride monomers, and a silicone resin. These resins may be used singly or in combination.

Examples of the amino resin include a urea-formaldehyde resin, a melamine resin, a benzoguanamine resin, a urea resin, a polyamide resin, and an epoxy resin. Examples of the polyvinyl resin include an acrylic resin, a polymethyl methacrylate resin, a polyacrylonitrile resin, a polyvinyl acetate resin, a polyvinyl alcohol resin, and a polyvinyl butyral resin. Examples of the polystyrene resin include a polystyrene resin, and a styrene-acryl copolymer resin. Examples of the halogenated olefin resin include polyvinyl chloride. Examples of the polyester resin include a polyethylene terephthalate resin, and a polybutylene terephthalate resin.

The resin layer may contain such material as conductive powder depending on the application; for the conductive powder, metal powder, carbon black, titanium oxide, tin oxide, zinc oxide, and the like are exemplified. These conductive powders preferably have an average particle diameter of 1 μm or less. If the average particle diameter is greater than 1 μm, it may be difficult to control electrical resistance.

The resin layer may be formed by dissolving the silicone resin or the like into a solvent to prepare a coating solution, uniformly coating the surface of the core material with the coating solution by a known coating process, and dying and baking the core material. Examples of the coating process include immersing process, spray process, and brush painting process.

The solvent is not particularly limited and cab be appropriately selected depending on the intended purpose. Examples thereof include toluene, xylene, methyl ethyl ketone, methyl isobutyl ketone, cellusolve, and butylacetate.

The baking process may be an externally heating process or an internally heating process, and can be selected from, for example, a process using a fixed type electric furnace, a fluid type electric furnace, a rotary type electric furnace or a burner furnace, and a process using microwave.

The content of the resin layer in the carrier is preferably 0.01% by mass to 5.0% by mass. In the case where the content is less than 0.01% by mass, it may be difficult to form a uniform resin layer on the surface of the core material, on the other hand, in the case where the content is more than 5.0% by mass, the resin layer becomes so thick that carrier particles may associate together. Thus, it may result in failure to obtain uniform carrier particles.

When the developer is a two-component developer, the content of the carrier in the two-component developer is not particularly limited and may be appropriately determined depending on the intended purpose; for example, it is preferably 90% by mass to 98% by mass, more preferably 93% by mass to 97% by mass.

Since the developer contains the toner of the present invention, it offers excellent charging properties at the time of the image formation, and can realize a stable formation of high-quality images.

The developer can be suitably applied to a variety of known electrophotographic image formation processes including a magnetic one-component developing process, non-magnetic one-component developing process, and two-component developing process, particularly to a toner container, process cartridge, image forming apparatus and image forming method of the present invention, all of which will be described below.

(Toner Container)

The toner container for use in the present invention contains a container, and the toner and/or developer of the present invention housed in the container.

The container is appropriately selected from the conventional contains depending on the purpose without any restrictions. Examples thereof include a container containing a body of the toner container and a cap, and the like.

The size, shape, structure, material and several features of the body of the toner container is not particularly limited, and can be appropriately determined depending on the intended purpose. For example, the body of the toner container preferably has a cylindrical shape, most preferably a cylindrical shape in which spiral grooves are formed on its inner surface that allow toner in the container to shift to the outlet along with rotation of the main body, and in which all or part of the spiral grooves have a bellow function.

Materials for the body of the toner container are not particularly limited, and are preferably those capable of providing accurate dimensions when fabricated. Examples thereof include resins, and the like. Among the resins, for example, polyester resins, polyethylene resins, polypropylene resins, polystyrene resins, polyvinyl chloride resins, polyacrylic acid resins, polycarbonate resins, ABS resins, and polyacetal resins are suitable.

The toner container can be readily stored and transferred, and is easy to handle. The toner container can be suitably used to supply toner by detachably attaching it to a process cartridge, image forming apparatus or the like to be described later.

(Process Cartridge)

The process cartridge for use in the present invention contains at least a latent electrostatic image bearing member configured to bear a latent electrostatic image thereon, and a developing unit configured to develop the latent electrostatic image formed on the latent electrostatic image bearing member using a developer so as to form a visible image, and may further contain other unit(s), if necessary.

The developing unit contains at least a developer container for storing the toner or developer of the present invention, and a developer carrier for carrying and transferring the toner or developer stored in the developer container, and may further contain a layer-thickness control member for controlling the thickness of the layer of the toner to be carried.

The process cartridge can be detachably disposed in an image forming apparatus of various electrophotographic systems, and is preferably disposed in the image forming apparatus for use in the present invention, which is described later.

The process cartridge contains, for example, as shown in FIG. 1, a built-in latent electrostatic image bearing member 101, a charging unit 102, a developing unit 104, a transferring unit 108, and a cleaning unit 107 and, if necessary, further contains additional unit(s). In FIG. 1, 103 denotes exposure light emitted from an exposing unit, and 105 denotes a recording medium.

Next, an image formation process by means of the process cartridge shown in FIG. 1 will be described. The latent electrostatic image bearing member 101 rotates in the direction of the arrow, charged by means of the charging unit 102 and is irradiated with the exposure light 103 by means of an exposing unit (not shown), whereby a latent electrostatic image corresponding to the exposed image is formed thereon. This electrostatic image is developed by means of the developing unit 104, and the resultant visible image is transferred to the recording medium 105 by means of the transferring unit 108. The recording medium 105 is then printed out. Subsequently, the surface of the latent electrostatic image bearing member 101 is cleaned by means of the cleaning unit 107, and any charges remained are removed by means of a charge-removing unit (not shown). This whole process is continuously repeated.

(Image Forming Method and Image Forming Apparatus)

The image forming method of the present invention contains a latent electrostatic image forming step, a developing step, a transferring step and a fixing step, and may further contain other step(s) such as a charge removing step, a cleaning step, a recycling step and a controlling step, which are optionally selected as needed.

The image forming apparatus for use in the present invention contains an latent electrostatic image bearing member, a latent electrostatic image forming unit, a developing unit, a transferring unit and a fixing unit, and may further contain other unit(s) such as a charge eliminating unit, a cleaning unit, a recycling unit and a controlling unit, which are optionally selected as needed.

-Latent Electrostatic Image Forming Step and Latent Electrostatic Image Forming Unit- The latent electrostatic image forming step is a step of forming a latent electrostatic image on a latent electrostatic image bearing member.

The material, shape, size, structure, and several features of the latent electrostatic image bearing member (referred to as "photoconductor," "electrographic photoconductor," or "image bearing member" in some cases) are not particularly limited. The latent electrostatic image bearing member can be appropriately selected from those known in the art. Suitable examples of the shape thereof include a drum shape, and the like. Suitable examples of the material thereof include inorganic photoconductive materials such as amorphous silicon and selenium, and organic photoconductive materials such as polysilane and phthalopolymethine. Among these, amorphous silicon is preferable in view of its long life.

The formation of the latent electrostatic image is carried out by, for example, exposing the latent electrostatic image bearing member imagewise after equally charging its entire surface. This step is performed by means of the latent electrostatic image forming unit.

The latent electrostatic image forming unit contains a charging device configured to equally charge the surface of the latent electrostatic image bearing member, and an exposing device configured to expose the surface of the latent electrostatic image bearing member imagewise.

The charging is carried out by, for example, applying voltage to the surface of the latent electrostatic image bearing member by means of the charging device.

The charging device can be appropriately selected depending on the intended purpose without any restrictions. Examples thereof include known contact-charging devices equipped with a conductive or semiconductive roller, blush, film or rubber blade; and known non-contact-charging devices utilizing corona discharge such as corotron or scorotoron.

The exposing is carried out by, for example, exposing the surface of the latent electrostatic image bearing member imagewise by means of an exposing unit.

The exposing unit is not particularly limited as long as it is capable of performing image-wise exposure on the surface of the charged latent electrostatic image bearing member by means of the charging device, and is appropriately selected depending on the intended use. Examples thereof include various exposing devices, such as optical copy devices, rod-lens-eye devices, optical laser devices, and optical liquid crystal shatter devices.

Note in the present invention that a backlight system may be employed for exposure, where image-wise exposure is performed from the back side of the latent electrostatic image bearing member.

-Developing Step and Developing Unit-

The developing step is a step of developing the latent electrostatic image using the toner of developer of the present invention to form a visible image.

The formation of the visible image can be carried out, for example, by developing the latent electrostatic image using the toner or developer of the present invention. This is performed by means of the developing unit.

The developing unit can appropriately selected from known developing units depending on the purpose without any restriction, provided that it is capable of developing using the toner or developer of the present invention. Suitable examples thereof include those having at least a developing device, which is capable of housing the toner developer of the present invention therein, and is capable of directly or indirectly applying the toner or developer to the latent electrostatic image. A developing device equipped with the toner container is more preferable.

The developing device may be of dry developing type or wet developing type, and may be designed either for monochrome or multiple-color. Suitable examples thereof include those having an agitation unit for agitating the toner or developer to provide electrical charges by frictional electrification, and a rotatable magnet roller.

In the developing device, the toner and carrier are mixed together and the toner is charged by friction, allowing the rotating magnetic roller to bear toner particles in such a way that they stand on its surface. In this way a magnetic blush is formed. Since the magnet roller is arranged in the vicinity of the latent electrostatic image bearing member (photoconductor), some toner particles on the magnetic roller that constitute the magnetic blush electrically migrate to the surface of the latent electrostatic image bearing member (photoconductor). As a result, a latent electrostatic image is developed by means of the toner, forming a visible image, or a toner image, on the surface of the latent electrostatic image bearing member (photoconductor).

The developer contained in the developing device is a developer containing the toner of the present invention. The developer may be either a one-component developer or a two-component developer. The toner contained in the developer is the toner of the present invention.

-Transferring Step and Transferring Unit-

The transferring step is a step of transferring the visible image onto a recording medium. A preferred embodiment of transferring involves two steps: primary transferring in which the visible image is transferred onto an intermediate transferring member; and secondary transferring in which the visible image transferred onto the intermediate transferring member is transferred onto a recording medium. A more preferable embodiment of transferring involves two steps: primary transferring in which a visible image is transferred onto an intermediate transferring member to form a complex image thereon by means of toners of two or more different colors, preferably full-color toners; and secondary transferring in which the complex image is transferred onto a recording medium.

The transferring step is carried out by, for example, charging the latent electrostatic image bearing member (photoconductor) by means of a transfer charging unit. This transferring step is performed by means of the transferring unit. A preferable embodiment of the transferring unit has two units: a transferring unit configured to transfer a visible image onto an intermediate transferring member to form a complex image; and a secondary transferring unit configured to transfer the complex image onto a recording medium.

The intermediate transferring member can be appropriately selected from conventional transferring media depending on the intended purpose, without any restrictions. Suitable examples thereof include a transferring belt, and the like.

The transferring unit (i.e., the primary and secondary transferring units) preferably contains a transferring device configured to charge and separate the visible image from the latent electrostatic image bearing member (photoconductor) and transfer it onto the recording medium. The number of the transferring unit to be disposed may be either one or more.

Examples of the transferring unit include a corona transferring device utilizing corona discharge, a transferring belt, a transferring roller, a pressure-transferring roller, and an adhesion-transferring device.

The recording medium can be appropriately selected from known recording media (recording sheets) without any restrictions.

-Fixing Step and Fixing Unit-

The fixing step is a step of fixing a transferred visible image onto the recording medium by means of the fixing unit. Fixing may be performed every time after each different toner has been transferred to the recording medium or may be performed in a single step after all different toners have been transferred to the recording medium.

The fixing device can be appropriately selected depending on the intended purpose, without any restrictions. Examples thereof include a heating-pressurizing unit, and the like. The heating-pressurizing unit is preferably a combination of a heating roller and a pressurizing roller, a combination of a heating roller, a pressurizing roller, and an endless belt, or the like.

In general, heating treatment by means of the heating-pressurizing unit is preferably performed at a temperature of 80° C. to 200° C.

Note in the present invention that a known optical fixing unit may be used in combination with or instead of the fixing step and fixing unit, depending on the intended purpose.

-Other Steps and Units-

The charge removing step is a step of applying a bias to the charged electrographic photoconductor for removal of charges. This is suitably performed by means of the charge eliminating unit.

The charge removing unit can be appropriately selected from conventional charge eliminating units depending on the intended purpose without any restrictions, provided that it is capable of applying a charge removing bias to the latent electrostatic image bearing member. Suitable examples thereof include a charge removing lamp and the like.

The cleaning step is a step of removing toner particles remained on the latent electrostatic image bearing member. This is suitably performed by means of the cleaning unit. The cleaning unit can be suitably selected from conventional cleaners depending on the intended use without any restriction, provided that it is capable of removing such toner particles from the latent electrostatic image bearing member. Examples thereof include a magnetic blush cleaner, a electrostatic brush cleaner, a magnetic roller cleaner, a blade cleaner, a blush cleaner, a wave cleaner, and the like.

The recycling step is a step of recovering the toner particles removed through the cleaning step to the developing unit. This is suitably performed by means of the recycling unit.

The recycling unit can be appropriately selected from conventional conveyance systems, without any restrictions.

The controlling step is a step of controlling the foregoing steps. This is suitably performed by means of the controlling unit.

The controlling unit can be appropriately selected depending on the intended use without any restrictions, provided that the operation of each step can be controlled. Examples thereof include equipments such as a sequencer, a computer, and the like.

One embodiment of the image forming method of the present invention by means of the image forming apparatus will be described with reference to FIG. 2.

An image forming apparatus 100 shown in FIG. 2 contains a photoconductor drum 10 (hereinafter referred to as a photoconductor 10) as the latent electrostatic image bearing member, a charging roller 20 as the charging unit, an exposure device 30 as the exposing unit, a developing device 40 as the developing unit, an intermediate transferring member 50, a cleaning device 60 as the cleaning unit having a cleaning blade, and a charge removing lamp 70 as the charge removing unit.

The intermediate transferring member 50 is an endless belt, and is so designed that it loops around three rollers 51 disposed its inside and rotates in the direction shown by the arrow by means of the rollers 51. One or more of the three rollers 51 also functions as a transfer bias roller capable of applying a certain transfer bias (primary bias) to the intermediate transferring member 50. A cleaning blade 90 is provided adjacent to the intermediate transferring member 50. There is provided a transferring roller 80 next to the intermediate transferring member 50 as the transferring unit capable of applying a transfer bias so as to transfer a developed image (toner image) to a transfer sheet 95, a recording medium (secondary transferring). Moreover, there is provided a corona charger 58 around the intermediate transferring member 50 for applying charges to the toner image transferred on the intermediate transferring member 50. The corona charger 58 is arranged between the contact region of the photoconductor 10 and the intermediate transferring member 50 and the contact region of the intermediate transferring member 50 and the transfer sheet 95.

The developing device 40 comprises a developing belt 41 (a developer bearing member), a black developing unit 45K, yellow developing unit 45Y, magenta developing unit 45M and cyan developing unit 45C, the developing units being positioned around the developing belt 41. The black developing unit 45K comprises a developer container 42K, a developer supplying roller 43K, and a developing roller 44K. The yellow developing unit 45Y comprises a developer container 42Y, a developer supplying roller 43Y, and a developing roller 44Y. The magenta developing unit 45M comprises a developer container 42M, a developer supplying roller 43M, and a developing roller 44M. The cyan developing unit 45C comprises a developer container 42C, a developer supplying roller 43C, and a developing roller 44C. The developing belt 41 is an endless belt looped around a plurality of belt rollers so as to be rotatable. A part of the developing belt 41 is in contact with the latent electrostatic image bearing member 10.

Figure 2:
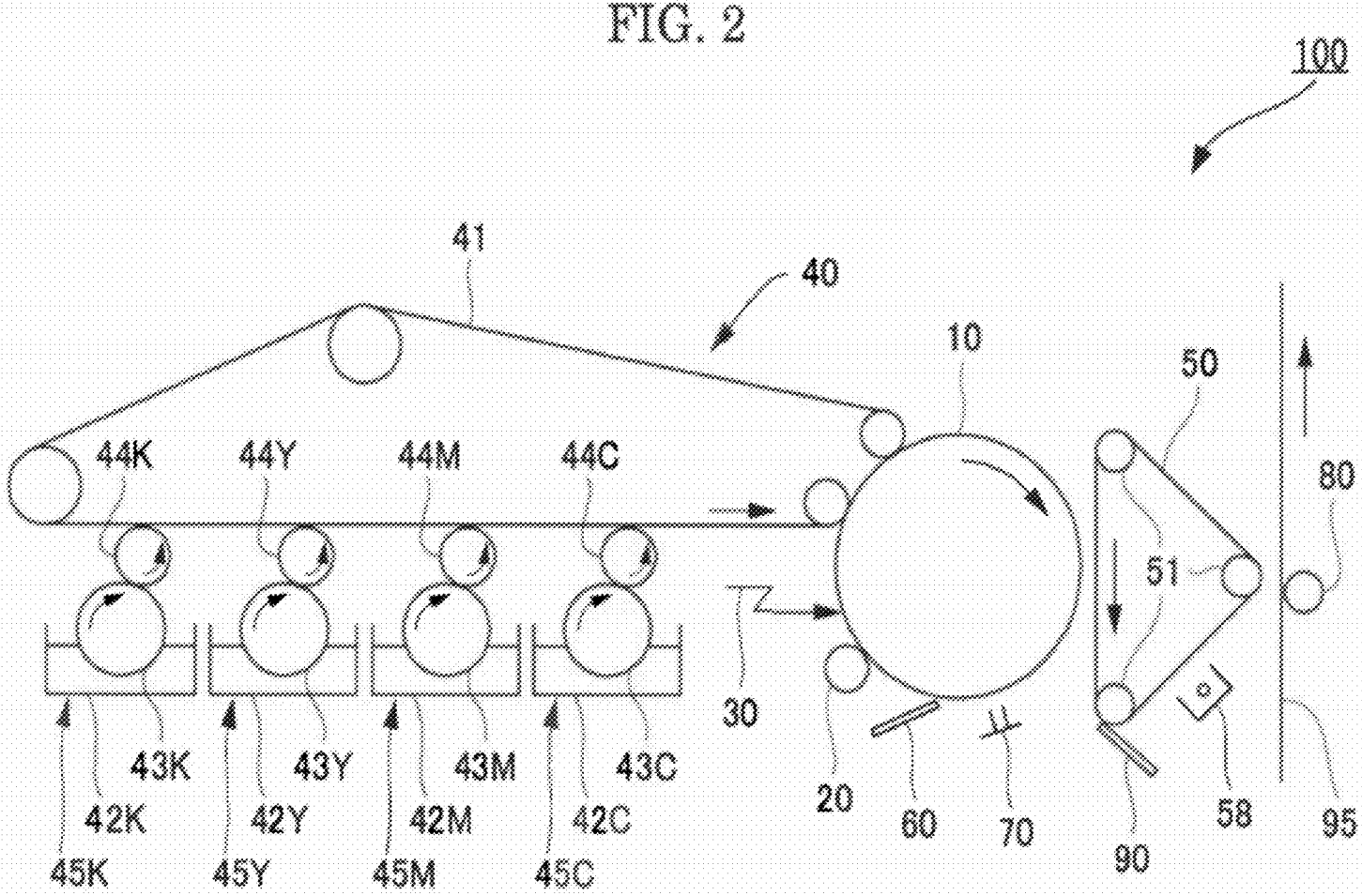
FIG. 2 is a schematic explanatory diagram showing an example of a procedure of an image forming method of the present invention by means of an image forming apparatus for use in the present invention.

In the image forming apparatus 100 shown in FIG. 2, the photoconductor drum 10 is uniformly charged by means of, for example, the charging roller 20. The exposure device 30 then applies light to the photoconductor drum 10 so as to form a latent electrostatic image. The latent electrostatic image formed on the photoconductor drum 10 is provided with toner from the developing device 40 to form a visible image (toner image). The roller 51 applies a bias to the toner image to transfer the visible image (toner image) onto the intermediate transferring member 50 (primary transferring), and further applies a bias to transfer the toner image from the intermediate transferring member 50 to the transfer sheet 95 (secondary transferring). In this way a transferred image is formed on the transfer sheet 95. Thereafter, toner particles remained on the photoconductor drum 10 are removed by means of the cleaning device 60, and charges of the photoconductor drum 10 are removed by means of the charge removing lamp 70 on a temporary basis.

Figure 3:
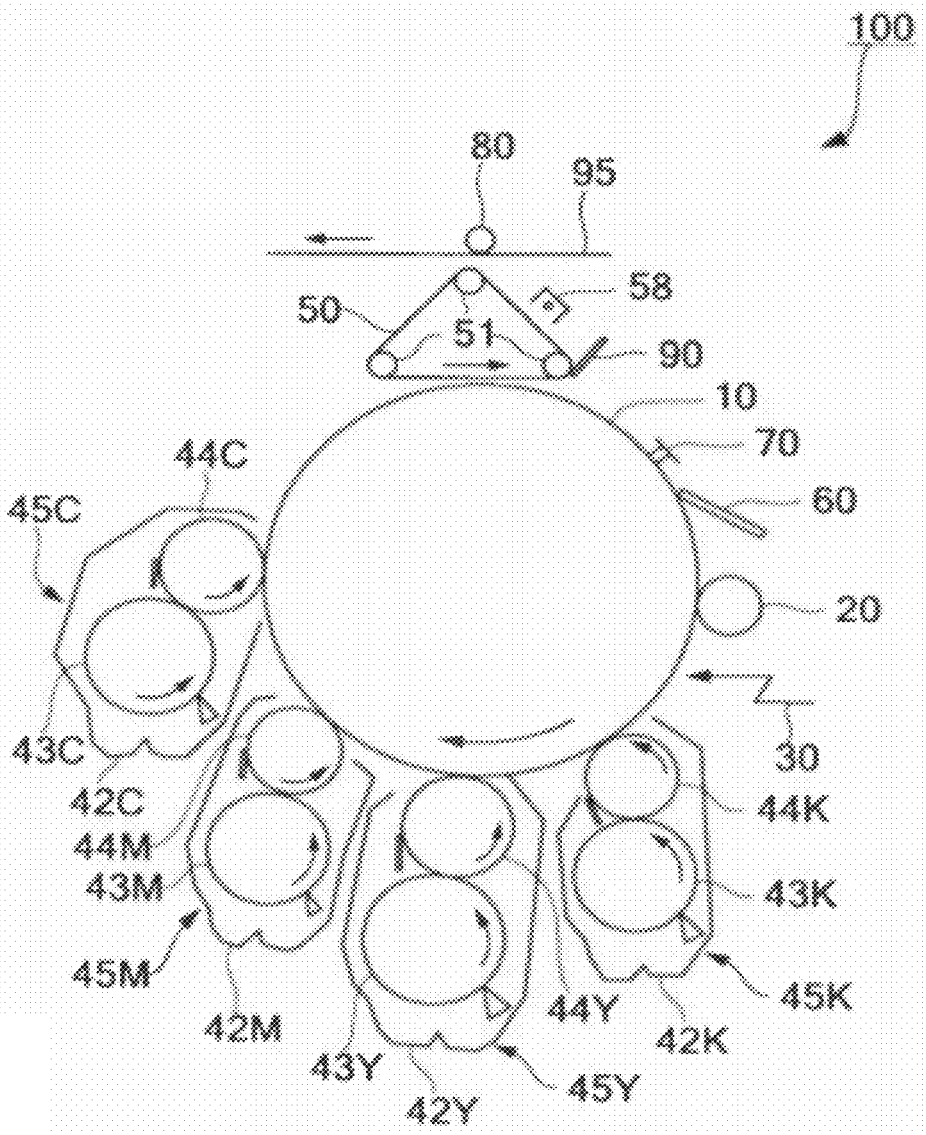
FIG. 3 is a schematic explanatory diagram showing another example of a procedure of an image forming method of the present invention by means of an image forming apparatus for use in the present invention.

Another embodiment of the image forming method of the present invention by means of the image forming apparatus will be described with reference to FIG. 3. The image forming apparatus 100 shown in FIG. 3 has an identical configuration and working effects to those of the image forming apparatus 100 shown in FIG. 2 except that this image forming apparatus 100 does not comprise the developing belt 41 and that the black developing unit 45K, yellow developing unit 45Y, magenta developing unit 45M and cyan developing unit 45C are disposed around the periphery of the photoconductor 10. Note in FIG. 3 that members identical to those in FIG. 2 are denoted by the same reference numerals.

Figure 4:
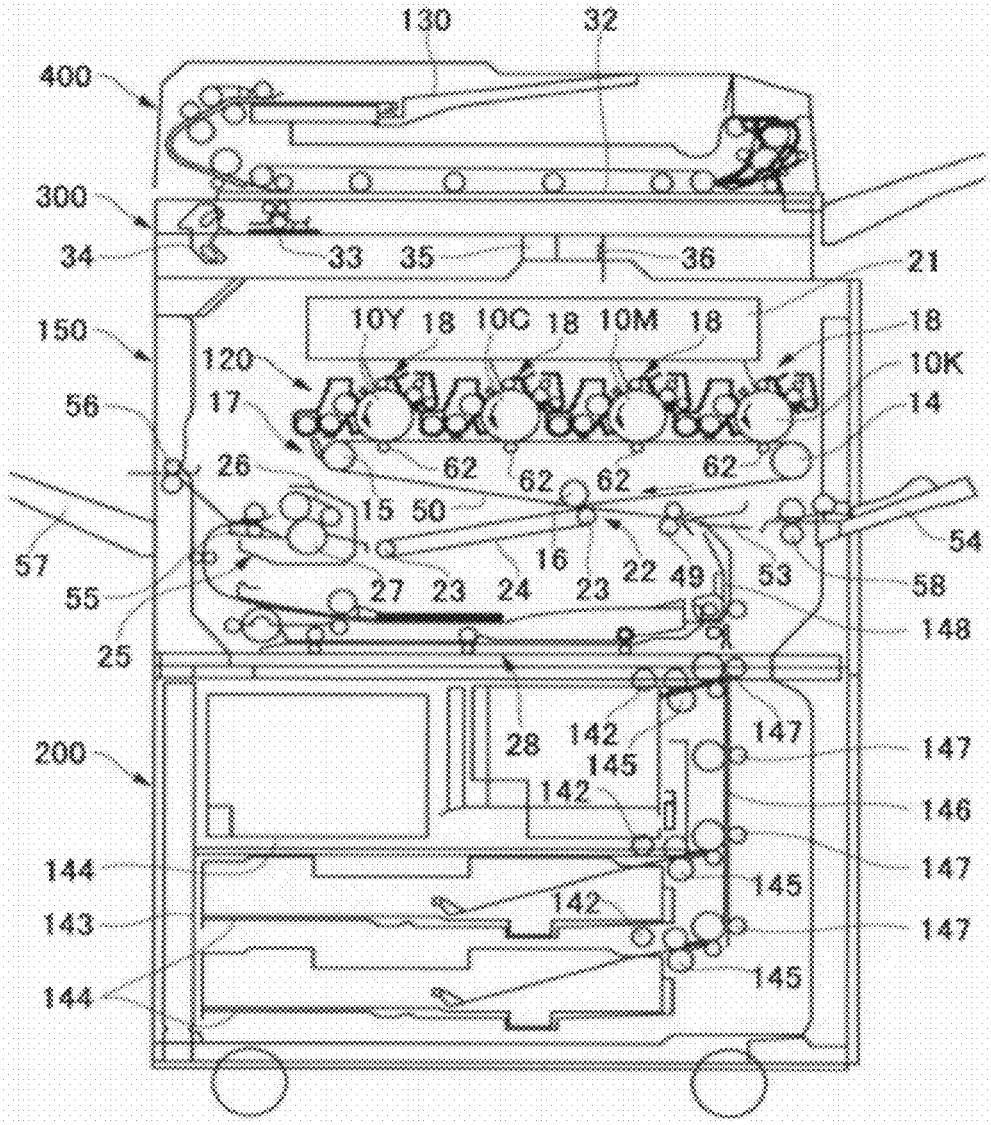
FIG. 4 is a schematic explanatory diagram showing an example of a procedure of an image forming method of the present invention by means of an image forming apparatus (a tandem-type color image forming apparatus) for use in the present invention.

Still another embodiment of the image forming method of the present invention by means of the image forming apparatus will be described with reference to FIG. 4. An image forming apparatus 100 shown in FIG. 4 is a tandem color image-forming apparatus. The tandem image forming apparatus comprises a copy machine main body 150, a feeder table 200, a scanner 300, and an automatic document feeder (ADF) 400. The copy machine main body 150 has an endless-belt intermediate transferring member 50 in the center. The intermediate transferring member 50 is looped around support rollers 14, 15 and 16 and is configured to rotate in a clockwise direction in FIG. 5. A cleaning device 17 for the intermediate transferring member is provided in the vicinity of the support roller 15. The cleaning device 17 removes toner particles remained on the intermediate transferring member 50.

On the intermediate transferring member 50 looped around the support rollers 14 and 15, four color-image forming devices 18—yellow, cyan, magenta, and black—are arranged, constituting a tandem developing unit 120. An exposing unit 21 is arranged adjacent to the tandem developing unit 120. A secondary transferring unit 22 is arranged across the intermediate transferring member 50 from the tandem developing unit 120. The secondary transferring unit 22 comprises a secondary transferring belt 24, an endless belt, which is looped around a pair of rollers 23. A paper sheet on the secondary transferring belt 24 is allowed to contact the intermediate transferring member 50. An image fixing device 25 is arranged in the vicinity of the secondary transferring unit 22. The image fixing device 25 comprises a fixing belt 26, an endless belt, and a pressurizing roller 27 which is pressed by the fixing belt 26.

In the tandem image forming apparatus, a sheet reverser 28 is arranged adjacent to both the secondary transferring unit 22 and the image fixing device 25. The sheet reverser 28 turns over s a transferred sheet to form images on the both sides of the sheet.

Next, full-color image formation (color copying) using the tandem developing unit 120 will be described. At first, a source document is placed on a document tray 130 of the automatic document feeder 400. Alternatively, the automatic document feeder 400 is opened, the source document is placed on a contact glass 32 of a scanner 300, and the automatic document feeder 400 is closed.

When a start switch (not shown) is pushed, the source document placed on the automatic document feeder 400 is transferred onto the contact glass 32, and the scanner is then driven to operate first and second carriages 33 and 34. In a case where the source document is originally placed on the contact glass 32, the scanner 300 is immediately driven after pushing of the start switch. Light is applied from a light source to the document by means of the first carriage 33, and light reflected from the document is further reflected by the mirror of the second carriage 34. The reflected light passes through an image-forming lens 35, and a read sensor 36 receives it. In this way the color document (color image) is scanned, producing 4 types of color information—black, yellow, magenta, and cyan.

Figure 5:
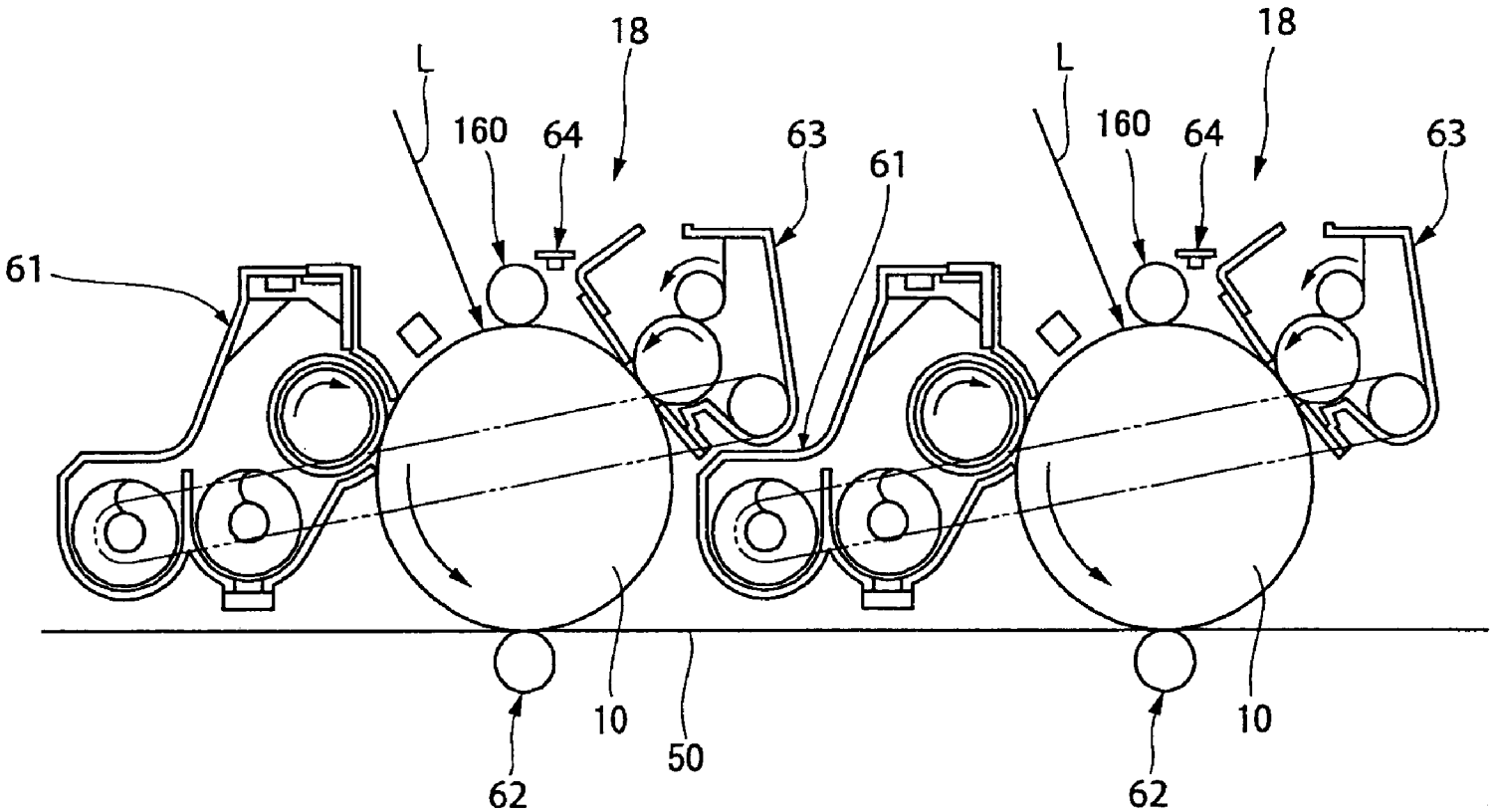
FIG. 5 is a partially enlarged schematic explanatory diagram of the image forming apparatus shown in FIG. 4.

Each piece of color information (black, yellow, magenta, and cyan) is transmitted to the image forming unit 18 (black image forming unit, yellow image forming unit, magenta image forming unit, or cyan image forming unit) of the tandem developing unit 120, and toner images of each color are formed in the image-forming units 18. As shown in FIG. 5, each of the image-forming units 18 (black image-forming unit, yellow image forming unit, magenta image forming unit, and cyan image forming unit) of the tandem developing unit 120 comprises: a latent electrostatic image bearing member 10 (latent electrostatic image bearing member for black 10K, latent electrostatic image bearing member for yellow 10Y, latent electrostatic image bearing member for magenta 10M, or latent electrostatic image bearing member for cyan 10C); a charging device 60 for uniformly charging the latent electrostatic image bearing member; an exposing unit for forming a latent electrostatic image corresponding to the color image on the latent electrostatic image bearing member by exposing it to light (denoted by "L" in FIG. 6) on the basis of the corresponding color image information; a developing device 61 for developing the latent electrostatic image using the corresponding color toner (black toner, yellow toner, magenta toner, or cyan toner) to form a toner image; a transfer charger 62 for transferring the toner image to the intermediate transferring member 50; a cleaning device 63; and a charge removing device 64. Thus, images of different colors (a black image, a yellow image, a magenta image, and a cyan image) can be formed based on the color image information. The black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred onto the intermediate transferring member 50 which rotates by means of support rollers 14, 15 and 16 (primary transferring). These toner images are overlaid on the intermediate transferring member 50 to form a composite color image (color transferred image).

Meanwhile, one of feed rollers 142 of the feed table 200 is selected and rotated, whereby sheets (recording sheets) are ejected from one of multiple feed cassettes 144 in the paper bank 143 and are separated one by one by a separation roller 145. Thereafter, the sheets are fed to a feed path 146, transferred by a transfer roller 147 into a feed path 148 inside the copying machine main body 150, and are bumped against a resist roller 49 to stop. Alternatively, one of the feed rollers 142 is rotated to eject sheets (recording sheets) placed on a manual feed tray. The sheets are then separated one by one by means of a separation roller 52, fed into a manual feed path 53, and similarly, bumped against the resist roller 49 to stop. Note that the resist roller 49 is generally earthed, but it may be biased for removing paper dusts on the sheets.

The resist roller 49 is rotated synchronously with the movement of the composite color image on the intermediate transferring member 50 to transfer the sheet (recording sheet) into between the intermediate transferring member 50 and the secondary transferring unit 22, and the composite color image is transferred onto the sheet by means of the secondary transferring unit 22 (secondary transferring). In this way the color image is formed on the sheet. Note that after image transferring, toner particles remained on the intermediate transferring member 50 are cleaned by means of the cleaning device 17.

The sheet (recording sheet) bearing the transferred color image is conveyed by the secondary transferring unit 22 into the image fixing device 25, where the composite color image (color transferred image) is fixed to the sheet (recording sheet) by heat and pressure. Thereafter, the sheet changes its direction by action of a switch hook 55, ejected by an ejecting roller 56, and stacked on an output tray 57. Alternatively, the sheet changes its direction by action of the switch hook 55, flipped over by means of the sheet reverser 28, and transferred back to the image transfer section for recording of another image on the other side. The sheet that bears images on both sides is then ejected by means of the ejecting roller 56, and is stacked on the output tray 57.

In the image forming method of the present invention by means of the image forming apparatus for use in the present invention, the toner of the present invention is used. As the toner of the present invention has an excellent low temperature fixing ability and stable cleaning properties for a long-period of time, and is capable of forming high quality images, high quality images can be efficiently provided in the image forming method of the present invention.

In accordance with the present invention, the conventional problems in the art can be solved, and there can be provided a toner capable of forming high quality images, and having an excellent low temperature fixing ability and stable cleaning properties for a long-period of time, and are further provided a developer, toner container, process cartridge, image forming method, and image forming apparatus all of which use such the toner.

EXAMPLES

The following explains examples of the present invention; however, it should be noted that the present invention is not confined to these examples in any way.

In Examples and Comparative Examples below, a content of isocyanate groups (NCO %), an acid value, a hydroxyl value, and a glass transition temperature (Tg) were measured in the following manners.

<Measurement of Weight Average Molecular Weight>

A weight average molecular weight of polyester was measured by gel permeation chromatography (GPC) under the following conditions:

Device: GPC-150C, manufactured by Waters Corporation
Column: KF801-807, manufactured by Shodex
Temperature: 40° C.
Solvent: tetrahydrofuran (THF)
Flow rate: 1.0 mL/min
Sample: 0.1 mL of the sample having a concentration of 1.10-0.6% was injected.

In this way a molecular weight distribution of the resin particles is obtained, and using a molecular weight calibration curve constructed from monodisperse polystyrene standards, the number-average molecular weight (Mn) and weight-average molecular weight (Mw) of the resin particles are calculated.

<Measurement of a Content of Isocyanate Groups (NCO %)>

NCO % was determined in accordance with the method specified in JIS K1603. Specifically, 2 g of a modified polyester was weighted, and then 5 ml of dry toluene was added thereto so as to completely dissolve the sample. Thereafter, 5 ml of 0.1M n-dibutylamine/toluene solution was added by using a pipette, and then the resulted mixture was gently stirred for 15 minutes. 5 ml of isopropanol was further added thereto, and the mixture was then stirred. This mixed solution was subjected to potentiometric titration by using 0.1M ethanolic hydrochloric acid titrating solution. The consumption of dibutylamine was calculated based on the thus obtained titer, and then a content of isocyanate groups was calculated.

The acid value (AV) and the hydroxyl value (OHV) were determined in the following manner. Note that, when a sample was not dissolved, dioxane, THF, or other solvent was used as a solvent.

Measuring device: Automatic potentiometric titrator, DL-53 Titrator, manufactured by Mettler-Toledo International Inc.
Electrode for use: DG113-SC, manufactured by Mettler-Toledo International Inc.
Software for analysis: LabX Light Version 1.00.000
Calibration for the device: Using a mixed solvent of 120 ml toluene and 30 ml ethanol
Measuring temperature: 23° C.

The conditions for the measurements are as follows:

Stir
Speed [%]: 25
Time[s]: 15
EQP titration
Titrant/Sensor
Titrant: $CH_3ONa$
Concentration [mol/L]: 0.1
Sensor: DG115
Unit of measurement: mV
Predispensing to volume
Volume [mL]: 1.0
Wait time [s]: 0
Titrant addition Dynamic
dE(set) [mV]: 8.0
dV(min) [mL]: 0.03
dV(max) [mL]: 0.5
Measure mode Equilibrium controlled
dE [mV]: 0.5
dt [s]: 1.0
t(min) [s]: 2.0
t(max) [s]: 20.0
Recognition
Threshold: 100.0
Steepest jump only: No
Range: No
Tendency: None
Termination
At maximum volume [mL]: 10.0
At potential: No
At slope: No
After number EQPs: Yes
n=1
comb. Termination conditions: No
Evaluation
Procedure Standard
Potential 1: No
Potential 2: No
Stop for reevaluation: No -Measuring Method of Acid Value- The acid value was measured in accordance with a measuring method specified in JIS K0070-1992, under the following conditions.

A sample was prepared by adding 0.5 g of the toner (0.3 of ethyl acetate soluble component) to 120 ml of toluene, stirring at a room temperature (23° C.) for about 10 hours so as to dissolve the toner, and further adding 30 ml of ethanol to the mixture to thereby yield a sample solution.

The measurement can be determined by calculations conducted by means of the aforementioned device. Specifically, the calculations were conducted in the following manner.

The titration was conducted with N/10 potassium hydroxide alcohol solution which had been previously standardized, and the acid value was determined by the following calculation based on the consumption of the potassium hydroxide alcohol solution.

$$\text{Acid value}=KOH(mol\ \text{number})\times N\times 56.1/\text{mass of the sample}$$

(Note: N Denotes a Factor of N/10KOH)

-Measuring Method of Hydroxyl Value- 0.5 g of a sample was precisely weighted in a 100 ml volumetric flask, and 5 ml of an acetylation reagent was added thereto. Thereafter, the mixture was heated by immersing the flask in a hot bath at the temperature of 100° C.±5° C. One to two hours later, the flask was removed from the bath, was left to stand to cool. The mixture was then added with water, and was oscillated to thereby decompose acetic anhydride. In order to complete the decomposition, the flask was again immersed in the hot bath to heat the mixture for more than 10 minutes, the mixture was then left to stand to cool, and the wall of the flask was washed well with an organic solvent. The potentiometric titration was conducted on this mixed solution using N/2 potassium hydroxide ethyl alcohol solution by means of the aforementioned electrode, to thereby determine a hydroxyl value. Note that, this determination method is in accordance with JIS K0070-1966.

<Measurement of Glass Transition Temperature (Tg)>

A glass transition temperature was determined in the following manner. The measurement was conducted by means of TA-60WS and DSC-60 manufactured by Shimadzu Corporation as measuring devices, under the following conditions.

[Conditions of the Measurement]

[Measurement Conditions]

Sample container: aluminum sample pan (with a lid)

Sample amount: 5 mg

Reference: aluminum sample pan (10 mg of alumina)

Atmosphere: nitrogen (flow rate: 50 ml/min)

Temperature condition:

Start temperature: 20° C.

Heating rate: 10° C./min

Finish temperature: 150° C.

Hold time: 0

Cooling rate: 10° C./min

Finish temperature: 20° C.

Hold time: 0

Heating rate: 10° C./min

Finish temperature: 150° C.

Measurement results are analyzed using date analysis software (TA-60, version 1.52, Shimadzu Corp.). The glass transition temperature is determined from DrDSC curve—a DSC transition curve for the second heating operation—by a glass transition temperature analysis function of the device. In the present invention the first shoulder portion of the graph, where glass transition starts, is defined as the glass transition temperature (Tg).

Example 1

-Synthesis of Non-Modified Polyester-

Into a reaction vessel equipped with a condenser tube, a stirrer, and a nitrogen inlet tube, there were added 229 parts by mass of 2 mol ethylene oxide adduct of bisphenol A, 529 parts by mass of 3 mol propylene oxide adduct of bisphenol A, 208 parts by mass of terephthalic acid, 46 parts by mass of adipic acid, and 2 parts by mass of dibutyltin oxide, and the mixture was allowed to react at 230° C. under normal pressure for 8 hours. Thereafter, the reaction solution was further reacted under the reduced pressure of 10 mmHg to 15 mmHg for 5 hours. After the reaction, 44 parts by mass of trimellitic anhydride was added into the reaction vessel, and the mixture was allowed to react at 180° C. under normal pressure for 2 hours, to thereby synthesis non-modified polyester.

The thus obtained non-modified polyester had a number average molecular weight of 2,500, a weight average molecular weight of 6,700, a glass transition temperature (Tg) of 43° C., and an acid value of 25 mgKOH/g.

-Preparation of Master Batch- 1,200 parts by mass of water, 540 parts by mass of carbon black (Printex 35 manufactured by Desussa A.G., DBP oil absorption: 42 ml/100 mg, pH: 9.5), and 1,200 parts by mass of the above-obtained non-modified polyester were mixed by means of HENSCHEL MIXER (manufactured by Mitsui Mining Co., Ltd.). The mixture was kneaded by means of a two-roller mill at 150° C. for 30 minutes, was rolled and cooled, and then was pulverized by means of a pulverizer (manufactured by Hosokawa Micron Corporation) to thereby prepare a master batch.

Into a reaction vessel equipped with a stirrer and a thermometer, there were added 378 parts by mass of non-modified polyester, 110 parts by mass of carnauba wax, and 947 parts by mass of ethyl acetate, and the mixture was stirred while elevating the temperature up to 80° C. After maintaining the temperature at 80° C. for 5 hours, it was cooled down to 30° C. for 1 hour. Thereafter, 500 parts by mass of the master batch, and 500 parts by mass of ethyl acetate were added to the reaction vessel, and the mixture was mixed for 1 hour to thereby obtain a material solution.

1,324 parts by mass of the thus obtained material solution was transferred to another reaction vessel, and was subjected to a dispersion treatment using a bead mill (ULTRA VISCO MILL, manufactured by Aimex Co., Ltd.). The bead mill was loaded with zirconia beads having a size of 0.5 mm in an amount of 80% by volume based on the total volume of the vessel, the liquid feeding speed was set at 1 kg/hour, and the disc rotating speed was set at 6 m/second. The mixture was passed through the bead mill three times to thereby disperse the carnauba wax. A wax dispersion was obtained in this manner.

To the wax dispersion, there was added 1,324 parts by mass of 65% by mass ethyl acetate solution of non-modified polyester. This mixture was passed through ULTRA VISCO MILL once under the same conditions mentioned above to thereby obtain a dispersion. To 200 parts by mass of the thus obtained dispersion, there was added 22 parts by mass of the below-mentioned organification-treated synthetic smectite (Lucentite SPN, manufactured by CO—OP Chemical Co., Ltd.), and the mixture was stirred for 30 minutes by means of T. K. Homo Disper (manufactured by Tokushu Kika Kogyo Co., Ltd.), to thereby obtained a pigment-wax dispersion of the toner material.

<Organification-Treated Synthetic Smectite (Lucentite SPN, Manufactured by CO—OP Chemical Co., Ltd.)>

The lucentite SPN was an organificationized synthetic smectite which was obtained by reacting a mixed solution of silicic acid and magnesium salt with an alkaline solution to synthesize a silicon-magnesium complex, removing electrolyte which was a by-product of the reaction, adding lithium ions together with at least one selected from sodium ions and fluorine ions to the silicone-magnesium complex so as to subject the mixture a hydrothermal reaction to thereby yield a synthetic smectite expressed by the general formula presented below (Lucentite SWN, manufactured by CO—OP Chemical Co., Ltd.), and subjecting the synthetic smectite to an organification treatment by using $CH_3(CH_3CH_2)_2N^+(CH_2CHOCH_3)_{25}H.Cl^-$ as an organification agent.

$$Na_{0.1\text{-}1.0}Mg_{2.4\text{-}2.9}Li_{0.1\text{-}0.6}Si_{3.5\text{-}4.5}O_{9.5\text{-}10.5}(X)_{1.5\text{-}2.5}$$

Note that, X denotes at least one selected from OH and F.

A cation exchange capacity of the lucentite SWN was 101 me/100 g.

-Synthesis of Urea-Modified Polyester-

Into a reaction vessel equipped with a condenser tube, a stirrer, and a nitrogen inlet tube, there were added 682 parts by mass of 2 mol ethylene oxide adduct of bisphenol A, 81 parts by mass of 2 mol propylene oxide adduct of bisphenol A, 283 parts by mass of terephthalic acid, 22 parts by mass of trimellitic anhydride, and 2 parts by mass of dibutyltin oxide, and the mixture was allowed to react at 230° C. under normal pressure for 8 hours. Thereafter, the mixture was further reacted under reduced pressure of 10 mHg to 15 mHg for 5 hours to thereby synthesize intermediate polyester.

The thus obtained intermediate polyester had a number average molecular weight of 2,100, a weight average molecular weight of 9,500, a glass transition temperature (Tg) of 55° C., an acid value of 0.5 mgKOH/g, and a hydroxyl value of 51 mgKOH/g.

Thereafter, into a reaction vessel equipped with a condenser tube, a stirrer, and a nitrogen inlet tube, there were added 410 parts by mass of the intermediate polyester, 89 parts by mass of isophorone diisocyanate, and 500 parts by mass of ethyl acetate, and the mixture was allowed to react at 100° C. for 5 hours to thereby synthesize urea-modified polyester (prepolymer). The content of free isocyanate groups in the thus obtained prepolymer was 1.53% by mass.

-Synthesis of Ketimine-

Into a reaction vessel equipped with a stirrer and a thermometer, there were added 170 parts by mass of isophorone diamine, and 75 parts by mass of methylethyl ketone, and the mixture was allowed to react at 50° C. for 5 hours to thereby synthesize a ketimine compound. The thus obtained ketimine compound had an amine value of 418 mgKOH/g.

-Preparation of Oil Phase Mixing Solution-

Into a reaction vessel, there were added 563 parts by mass of the pigment-wax dispersion of the toner material, 115 parts by mass of the prepolymer, and 2.9 parts by mass of the ketimine compound, and the mixture was mixed by means of T. K. Homo Disper (manufactured by Tokushu Kika Kyogyo Co., Ltd.) at 5.00 rpm for 1 minute to thereby obtain an oil phase mixing solution.

-Preparation of Resin Particle Dispersion-

Into a reaction vessel equipped with a stirrer and a thermometer, there were added 683 parts by mass of water, 11 parts by mass of sodium sulfate of ethylene oxide methacrylate adduct (ELEMINOL RS-30, manufactured by Sanyo Chemical Industries, Ltd.), 83 parts by mass of styrene, 83 parts by mass of methacrylic acid, 110 parts by mass of butyl acrylate, and 1 part by mass of ammonium persulfate, and the mixture was stirred at 400 rpm for 15 minutes to thereby obtain an emulsion. The emulsion was heated so as to elevate the temperature up to 75° C., and was allowed to react for 5 hours. Thereafter, 30 parts by mass of 1% by mass ammonium persulfate aqueous solution was added thereto, and the mixture was allowed to mature at 75° C. for 5 hours to thereby obtain an aqueous dispersion [particle dispersion] of a vinyl resin (styrene-methacrylic acid-butyl acrylate-sodium sulfate of ethylene oxide methacrylate adduct copolymer).

The thus obtained [particle dispersion 1] was subjected to the measurement of a volume average particle diameter by means of a laser scattering particle size distribution analyzer (LA-920, manufactured by Horiba Ltd.), and it was found out that the [particle dispersion 1] had a volume average particle diameter of 105 nm. Moreover, a portion of the thus obtained [particle dispersion 1] was taken out, and dried so as to separate a resin component therefrom. The resin component had a glass transition temperature (Tg) of 59° C., and a weight average molecular weight (Mw) of 150,000.

-Preparation of Aqueous Medium- 990 parts by mass of water, 83 parts by mass of the resin particle dispersion, 37 parts by mass of 48.5% by mass sodium dodecyldiphenylether disulphonate aqueous solution (ELEMINOL MON-7, manufactured by Sanyo Chemical Industries, Ltd.), 135 parts by mass of 1% by mass sodium carboxymethyl cellulose aqueous solution (CELLOGEN BS-H-3, manufactured by Dai-ichi Kogyo Seiyaku Co., Ltd.) as a high polymer dispersant, and 90 parts by mass of ethyl acetate were mixed and stirred to thereby obtain an aqueous medium.

1,200 parts by mass of the aqueous medium was added with 681 parts by mass of the oil phase mixing solution, and the mixture was mixed by means of T.K. Homomixer at 13,000 rpm for 20 minutes to thereby prepare a dispersion (emulsified slurry).

Thereafter, the thus obtained emulsified slurry was added into a reaction vessel equipped with a stirrer and a thermometer, was treated at 30° C. for 8 hours so as to remove the solvent therefrom, and was matured at 45° C. for 4 hours to thereby obtain a dispersion slurry.

-Washing and Drying- 100 parts by mass of the dispersion slurry was filtered under reduced pressure. 100 parts by mass of ion-exchanged water was added to the filtered cake, and the mixture was mixed by means of T.K. Homomixer at 12,000 rpm for 10 minutes. Thereafter, this mixture was filtered.

The thus obtained filtered cake was added with 10% by mass hydrochloric acid so as to adjust pH to be 2.8, mixed by means of T.K. Homomixer at 12,000 rpm for 10 minutes, and then filtered.

Again, the thus obtained filtered cake was added with 300 parts by mass of ion-exchanged water, mixed by means of T.K. Homomixer at 12,000 rpm for 10 minutes, and then filtered. This operation was conducted twice to thereby obtain a final filtered cake.

The thus obtained final filtered cake was dried by means of a wind-circulation dryer at 45° C. for 48 hours, and sieved with a mesh having an opening of 75 m, to thereby obtain toner base particles.

-Addition of External Additive-

To 100 parts by mass of the thus obtained toner base particles, 0.1 parts by mass of hydrophobic silica and 0.5 parts by mass of hydrophobic titanium oxide were added as external additives, and the particles were mixed by means of HENSCHEL MIXER (manufactured by Mitsui Mining Co., Ltd.) to thereby prepare a toner of Example 1.

Figure 6:
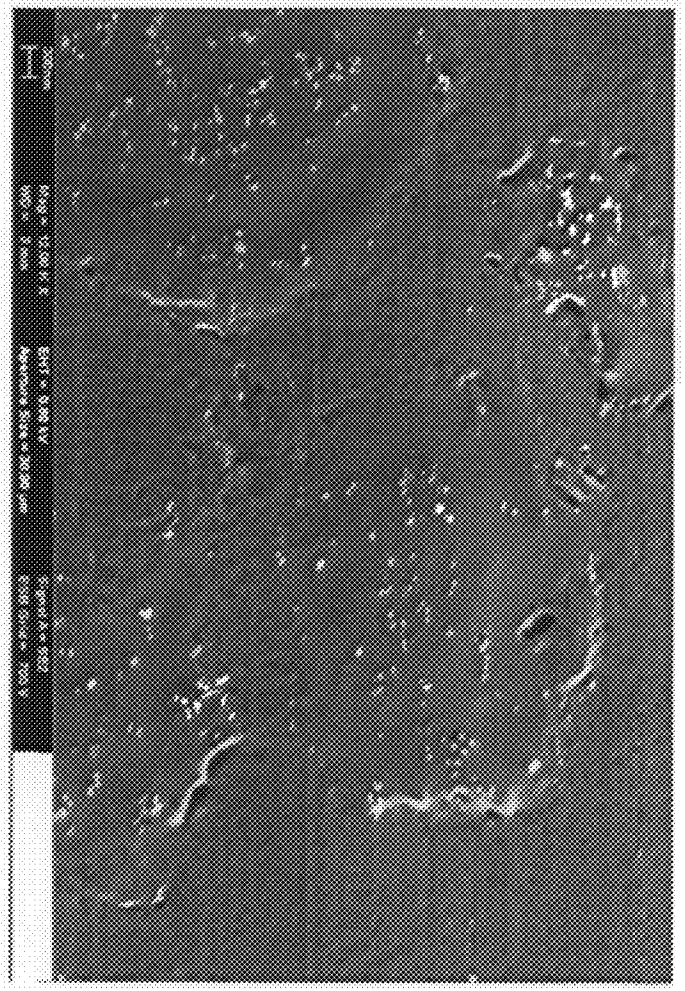
FIG. 6 shows an example of a secondary electron image of a cross section of the toner of Example 1 observed under FE-SEM.
Figure 7:
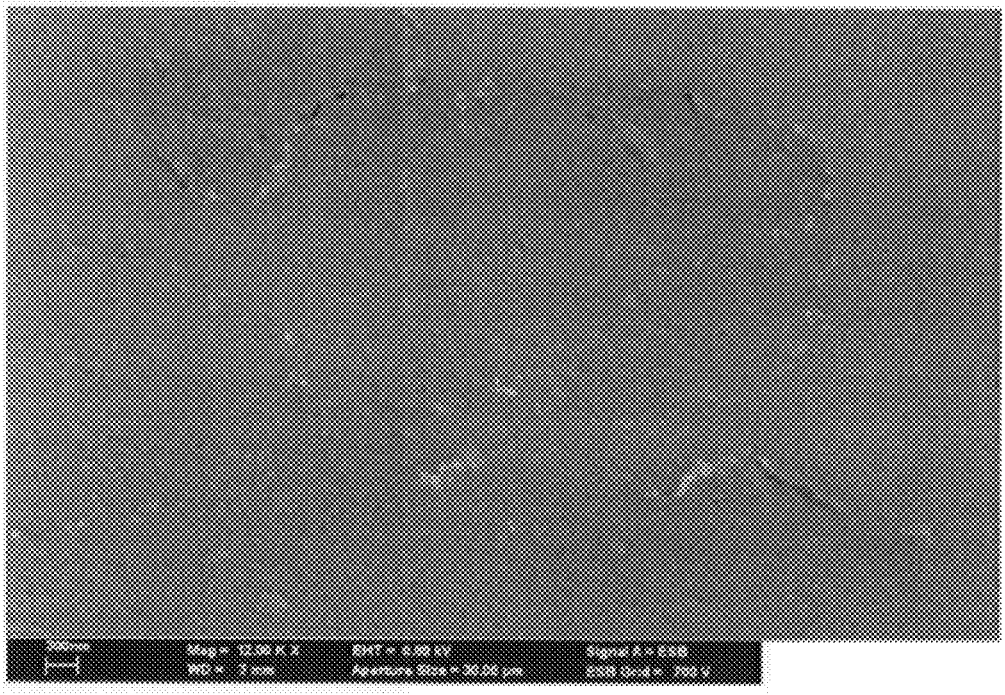
FIG. 7 shows an example of a backscattering electron image of the same view as the cross section of the toner of FIG. 6, observed under FE-SEM, and the parts where look white are the positions where the layered inorganic compound is present.

FIG. 6 is a photograph showing a secondary electron image of a cross-section of the thus obtained toner of Example 1, taken by FE-SEM. FIG. 7 is an observation photograph of a backscattered electron image of the same cross-sectional view as FIG. 6 taken by FE-SEM.

Figure 8:
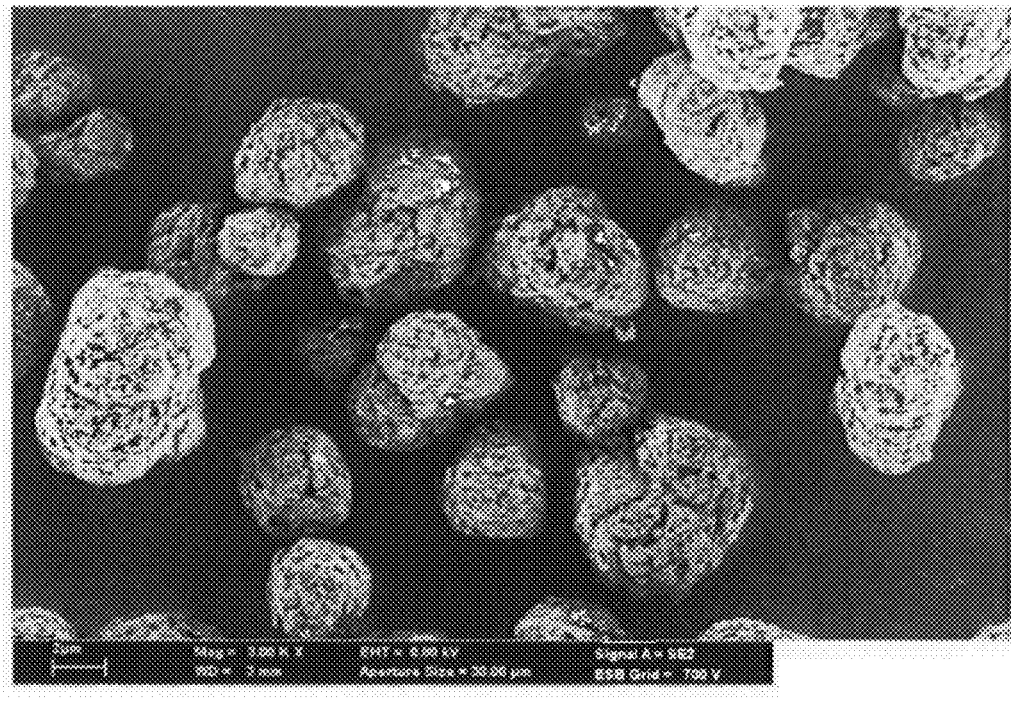
FIG. 8 shows an example of a secondary electron image of the toner of Example 1 observed under FE-SEM.
Figure 9:
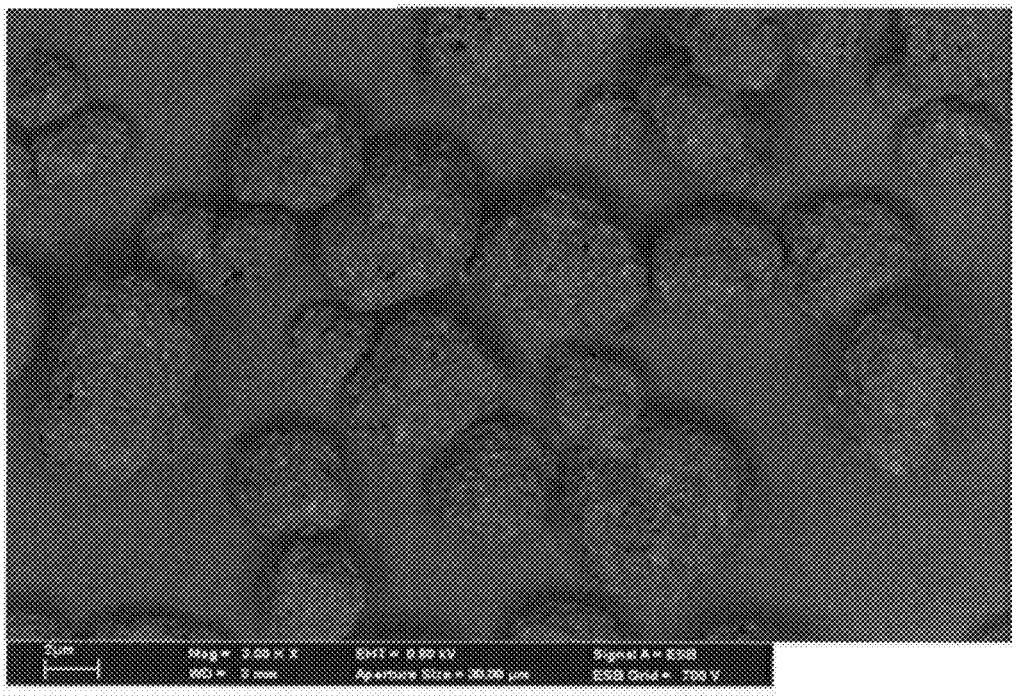
FIG. 9 shows an example of a backscattering electron image of the same view as the toner of FIG. 8, observed under FE-SEM, and the parts where look white are the positions where layered inorganic compound is present.

Moreover, FIG. 8 is an observation photograph of a secondary electron image of the toner of Example 1, taken by FE-SEM. FIG. 9 is an observation photograph of a backscattered electron image of the same view as FIG. 8 taken by FE-SEM, and the parts in the picture where look in white are the positions where the layered inorganic compound is present.

Example 2

-Preparation of Toner-

A toner was prepared in the same manner as in Example 1, provided that the addition amount of the synthetic smectite (Lucentite SPN, manufactured by CO—OP Chemical Co., Ltd.) was changed from 22 parts by mass to 11 parts by mass.

Example 3

-Preparation of Toner-

A toner was prepared in the same manner as in Example 1, provided that the addition amount of the synthetic smectite (Lucentite SPN, manufactured by CO—OP Chemical Co., Ltd.) was changed from 22 parts by mass to 44 parts by mass.

Example 4

-Preparation of Toner-

A toner was prepared in the same manner as in Example 1, provided that the addition amount of the synthetic smectite (Lucentite SPN, manufactured by CO—OP Chemical Co., Ltd.) was changed from 22 parts by mass to 100 parts by mass.

Example 5

-Preparation of Toner-

A toner was prepared in the same manner as in Example 1, provided that the addition amount of the synthetic smectite (Lucentite SPN, manufactured by CO—OP Chemical Co., Ltd.) was changed from 22 parts by mass to 6 parts by mass.

Comparative Example 1

-Preparation of Toner-

A toner was prepared in the same manner as in Example 1, provided that the synthetic smectite (Lucentite SPN, manufactured by CO—OP Chemical Co., Ltd.) was not added.

Comparative Example 2

-Preparation of Toner-

A toner was prepared in the same manner as in Example 1, provided that 22 parts by mass of the synthetic smectite (Lucentite SPN, manufactured by CO—OP Chemical Co., Ltd.) were replaced with 22 parts by mass of a montmorillonite layered inorganic compound modified with quaternary ammonium salt having a benzyl group at least a part thereof (Clayton APA, manufactured by Southern Clay Products).

Comparative Example 3

-Preparation of Toner-

A toner was prepared in the same manner as in Example 1, provided that 22 parts by mass of the synthetic smectite (Lucentite SPN, manufactured by CO—OP Chemical Co., Ltd.) were replaced with 110 parts by mass of (MEK 20% by mass solution) organo silica sol (MEK-SET-UP, manufactured by Nissan Chemical Industries, Ltd., average particle diameter: 10 nm).

Thereafter, each of toners of Examples 1-5 and Comparative Examples 1-3 was subjected to the measurements of various properties in the following manners. The results are shown in Table 1.

<Measurement of Breadth and Length of Layered Inorganic Compound in Toner>

The breadth and length of the layered inorganic compound present in the toner were measured by observing under SEM. The presence of the layered inorganic compound in the surface of the toner was observed as a secondary electron image and a backscattered electron image by fixing the toner on a carbon tape. The presence of the layered inorganic compound in the whole area of the toner was observed in the following manner. At first, the toner was embedded in an epoxy resin, and the epoxy resin was cut by means of a microtome so as to show a cross section of the toner. In order to carry out observation under SEM easily, as the cross sectional toner sample, a part of a sample block wherein the toner was fixed in the epoxy resin was cut, and the sample block was set on a platform to conduct an observation of a secondary electron image and a backscattered electron image (ESB Grid: 700V) by means of FE-SEM at accelerating voltage of 0.8 kV. In each sample, a view in which contains a few toner particles were in at the magnification of 3,000 times, and a view in which one toner particle was in at the magnification of 12,000 times were taken on both the surface and the cross section for observation, and then the breadth and length of the layered inorganic compound present were measured. An average breadth and average length of the layered inorganic compound were determined by taking an average from twenty samples (n=20).

As a measuring device, a thermal type of a field emission scanning electron microscope (FE-SEM), ULTRA55 (manufactured by Carl Zeiss Co., Ltd.), was used.

<Measurement of Average Breadth of Layered Inorganic Compound>

The toner was added in toluene so as to prepare a toluene solution of the toner, and the layered inorganic compound was extracted by using ion-exchanged water. The extracted layered inorganic compound was dried, and was subjected to an observation by X-ray diffraction to thereby detect a diffraction peak corresponding to an interlayer distance at the side of a low angle. As a X-ray diffraction system, X'pert Pro manufactured by Philips Electronics Japan was used. A sample was placed in a groove having a depth of 0.5 mm on a glass plate, and was fixed at the predetermined sample position on a platform of the diffractometer. The analysis was carried out by using a tube voltage 45 kV vessel (Multisizer III, manufactured by Beckman Coulter K.K.) with an aperture diameter of 100 m, and using an analysis software (Beckman Coulter Multisizer III version 3.51).

Specifically, 0.5 ml of 10% by mass a surfactant (alkylbenzen sulfonate, NEOGEN SC-A, manufactured by Dai-ichi Kogyo Seiyaku Co., Ltd.), and 0.5 g of each toner were added into a 100 ml glass beaker, were mixed by a micro spatula, and were further added with 80 ml of ion-exchanged water. The thus obtained dispersion was subjected to a dispersion treatment for 10 minutes by means of an ultrasonic disperser (W-113MK-II, manufactured by Honda Electronics Co., Ltd.). The thus obtained dispersion was measured by means of Multisizer III, by using ISOTON III (manufactured by Beckman Coulter K.K.) as a solution for the measurement. The measurement was carried out by dripping the toner sample dispersion so that the device showed the concentration to be 8%±2%. In this measuring method, it was important to maintain the concentration to be 8%±2% in view of measuring reproducibility of the particle diameter. When the concentration was maintained within this range, there was no error in the measurement of the particle diameter.

<Average Circularity of Toner>

The average circularity of the toner was measured by means of a flow particle image analyzer (FPIA-2100, manufactured by Sysmex Corporation). Specifically, into a container, there were added 100-150 ml of water in which impurity substances had been previously removed, 0.1-0.5 ml of a surfactant (alkylbenzene sulfonate) as a dispersant, and 0.1-0.5 g of each toner, and the mixture was dispersed. The thus obtained dispersion was subjected to a dispersion treatment for about 1 to 3 minutes by means of an ultrasonic disperser (manufactured by Honda Electronics Co., Ltd.) so as to control the concentration of the dispersion to be 3,000 particles/μl to 10,000 particles/μl, and then the shapes and distributions of the toner were measured. The average circularity of the toner was calculated based on the result from the measurements.

<Presence of Filler Layer>

The surface and cross section of the toner were observed by means of a scanning electron microscope (SEM) to confirm the presence of the filler layer in an area where was within 0.5 μm depth from the surface of the toner.

TABLE 1

| | Filler content (mass %) | Dv (μm) | Dv/Dn | Length (nm) | Breadth (nm) | Average circularity | Filler layer |
|---|---|---|---|---|---|---|---|
| Ex. 1 | 1.1 | 5.6 | 1.12 | 60 | 1.9 | 0.962 | yes |
| Ex. 2 | 0.6 | 6.2 | 1.09 | 60 | 1.9 | 0.967 | yes |
| Ex. 3 | 2.2 | 5.8 | 1.21 | 60 | 1.9 | 0.954 | yes |
| Ex. 4 | 5.0 | 6.2 | 1.28 | 60 | 1.9 | 0.928 | yes |
| Ex. 5 | 0.3 | 6.0 | 1.10 | 60 | 1.9 | 0.971 | yes |
| Com. 1 | 0 | 5.4 | 1.11 | — | — | 0.980 | no |
| Com. 2 | 1.1 | 5.3 | 1.19 | 180 | 3 | 0.972 | yes |
| Com. 3 | 1.1 | 6.8 | 1.15 | 10 | 10 | 0.965 | yes |

Note that, in Table 1, Dv denotes a volume average particle diameter, and Dv/Dn denotes a particle size distribution.

-Preparation of Carrier-

To 100 parts by mass of toluene, there were added 100 parts by mass to silicone resin (organo straight silicone), 5 parts by mass of γ-(2-aminoethyl)aminopropyltrimethoxysilane, and 10 parts by mass of carbon black, and the mixture was dispersed by means of a homomixer for 20 minutes to thereby prepare a coating solution of a coat layer. The thus obtained coating solution of a coat layer was applied to, and coated on surfaces of 1,000 parts by mass of spherical magnetite having a particle diameter of 50 μm to thereby prepare magnetic carrier.

-Preparation of Developer- 5 parts by mass of each of the toners according to Examples 1-5 and Comparative Examples 1-3 which had been treated with the external additives were mixed with 95 parts by mass of the carrier by means of a ball mill, to thereby prepare two-component developers of Examples 1-5 and Comparative Examples 1-3, respectively.

The thus obtained two-component developers were each evaluated in terms of cleaning ability, and fixing ability (offset occurring temperature, and minimum fixing temperature) in the following manners. The results are shown in Table 2.

<Cleaning Ability>

After printing initial copy, $1000^{th}$ copy, $100,000^{th}$ copy by means of a tandem type image forming apparatus (Imagio Neo C380, manufactured by Ricoh Company Limited), the toner remained on the photoconductor after passed through the cleaning device was transferred to a white paper by using a scotch tape (manufactured by Sumitomo 3M Limited), and the transferred toner was subjected to the measurement of image density by means of Macbeth reflection densitometer RD514, and the results were evaluated based on the following criteria.

[Evaluation Criteria]

A: a difference with a blanked white paper was 0.01 or less

B: a difference with a blanked white paper was more than 0.01

<Fixing Ability (Offset Occurring Temperature and Minimum Fixing Temperature)>

A tandem type color image forming apparatus (Imagio Neo C380, manufactured by Ricoh Company Limited) was modified to be the image forming apparatus an oil-free fixing system by removing a silicone oil application system from the fixing unit of the image forming apparatus, and was tuned to be able to control the temperature and linear velocity of the fixing unit. The fixing ability (offset occurring temperature and minimum fixing temperature) was evaluated by using this image forming apparatus, and a normal paper (Type 6000<70W>Y mesh, manufactured by Ricoh Company Limited).

Note that, the aforementioned tandem type image forming apparatus was capable of repetitive printings at 38 pieces per minute on A4 size paper. At this time, the evaluation was conducted while controlling the linear velocity of the fixing roller at 125 mm/s, and variously changing the temperature of the fixing roller.

-Offset Occurring Temperature-

The image formation was performed by controlling the tandem type color image forming apparatus so that 0.85 mg±0.3 mg of the toner in each color of yellow, magenta, cyan, and black was developed as a solid image of each color on a normal paper. The thus obtained image was fixed while changing the temperature of the heating roller to determine a fixing temperature which occurred hot offset (offset occurring temperature), and the results were evaluated based on the following criteria.

[Evaluation Criteria]

A: 210° C. or higher

B: 190° C. or higher, but lower than 210° C.

C: 170° C. or higher, but lower than 190° C.

D: lower than 170° C.

-Minimum Fixing Temperature-

A copying test was performed by using the tandem type image forming apparatus and the normal paper. The minimum fixing temperature was determined as a temperature of the fixing roller at which the thus obtained fixed image had 70% or more of a remaining ratio of an image density after rubbing the fixed image by using a fabric pad, and the results were evaluated based on the following criteria.

[Evaluation Criteria]

A: lower than 110° C.

B: 110° C. or higher, but lower than 130° C.

C: 130° C. or higher, but lower than 150° C.

D: 150° C. or higher

<Charging Stability>

The resistance test was performed by repetitively outputting 100,000 prints by using each toner and a character image pattern having an imaging area of 12%, and the change in the charging amount was evaluated. A small amount of the developer on the sleeve was taken away, and the change in the charging amount was determined in accordance with a blow-off method, and the results were evaluated based on the following criteria.

[Evaluation Criteria]

A: the change in the charging amount was less than 5 μc/g

B: the change in the charging amount was 5 μc/g or more, but 105 μc/g or less

C: the change in the charging amount was more than 5 μc/g

<Image Density>

After outputting a solid image having a low deposition amount of 0.3±0.1 mg/cm$^2$ formed on a transfer paper of a normal paper (Type 6200, manufactured by Ricoh Company Limited), the image density of the thus obtained image was measured by means of X-Rite (manufactured by X-Rite), and the results were evaluated based on the following criteria.

[Evaluation Criteria]

A: image density was 1.4 or more

B: image density was less than 1.4

TABLE 2

| | cleaning ability | | | minimum fixing | hot offset | | |
|---|---|---|---|---|---|---|---|
| | initial print | 1000th print | 100000th print | temperature | resistance | image density | charging stability |
| Ex. 1 | A | A | A | A | A | A | A |
| Ex. 2 | A | A | A | A | B | A | A |
| Ex. 3 | A | A | A | B | A | A | A |
| Ex. 4 | A | A | A | C | A | A | A |
| Ex. 5 | A | A | A | A | C | A | B |
| Com. 1 | B | N/D | N/D | A | C | A | C |
| Com. 2 | A | A | B | B | B | A | B |
| Com. 3 | A | A | A | D | C | B | C |

Note that, the column of hot offset resistance shows the evaluations of the offset occurring temperature, and N/D shown in Comparative Example 1 denotes that the results were impossible to evaluate.

The toner of the present invention is suitable used for high quality image formation in an electrophotography system, as the toner of the present invention has excellent low temperature fixing ability and stable cleaning ability for long-period of time.

Moreover, the developer, toner container, process cartridge, image forming apparatus and image forming method of the present invention each using the toner of the present invention are widely applicable in a full-color photocopier, a full-color laser printer, a full-color normal paper fax machine, and the like by using a direct or indirect electrophotographic multicolor image developing method.

What is claimed is:

1. A toner comprising at least:

a binder resin; and filler comprising a layered inorganic compound, wherein the layered inorganic compound is a smectite group clay mineral cleaved to form particles in the toner, and the particles have a breadth of 0.5 nm to 4 nm, and a length of 10 nm to 90 nm, and wherein the smectite group clay mineral is a synthetic smectite expressed by the following general formula 1:

$$Na_{0.1-1.0}Mg_{2.4-2.9}Li_{0.1-0.6}Si_{3.5-4.5}O_{9.5-10.5}(X)_{1.5-2.5} \quad \text{General formula 1}$$

wherein X denotes at least one selected from OH and F, and wherein the synthetic smectite is obtained by a process comprising reacting a mixed solution of silicic acid and magnesium salt with an alkaline solution to synthesize a silicon-magnesium complex, removing electrolyte which is a by-product of the reaction, adding lithium ions together with at least one selected from sodium ions and fluorine ions to the silicone-magnesium complex so as to subject the mixture to a hydrothermal reaction.

2. The toner according to claim 1, wherein the toner has a filler layer comprising the layered inorganic compound in an area adjacent to a surface of the toner.

3. The toner according to claim 1, wherein a content of the layered inorganic compound in the toner is 0.5% by mass to 5% by mass.

4. The toner according to claim 1, wherein the layered inorganic compound has a cation exchange capacity of 80 me/100 g to 120 me/100 g.

5. The toner according to claim 1, wherein the toner is obtained by a process comprising dissolving or dispersing a toner material comprising an active hydrogen group containing compound, a polymer reactive with the active hydrogen group containing group, a binder resin and the filler in an organic solvent so as to prepare a toner solution, emulsifying or dispersing the toner solution in an aqueous medium so as to prepare an emulsified dispersion, reacting the active hydrogen group containing compound and the polymer reactive with the active hydrogen group containing compound in the aqueous medium so as to generate an adhesive base in the shape of particles, and removing the organic solvent.

6. The toner according to claim 5, wherein the organic solvent is ethyl acetate.

7. The toner according to claim 5, wherein the binder resin comprises non-modified polyester, and wherein a mass ratio (polymer/non-modified polyester) of the polymer reactive with the active hydrogen group containing compound to the non-modified polyester is 5/95 to 80/20.

8. The toner according to claim 1, wherein the toner has an average circularity of 0.925 to 0.970.

9. The toner according to claim 1, wherein the toner has a volume average diameter (Dv) of 3 μm to 10 μm, and a ratio (Dv/Dn) of 1.00 to 1.30 wherein the ratio (Dv/Dn) is a ratio of the volume average particle diameter to a number average particle diameter.

10. A developer comprising:

a carrier; and the toner of claim 1.

11. An image forming method, comprising:

forming a latent electrostatic image on a latent electrostatic image bearing member;

developing the latent electrostatic image using the toner of claim 1 so as to form a visible image;

transferring the visible image onto a recording medium; and fixing the transferred image on the recording medium.

12. A toner comprising at least:

a binder resin; and filler comprising a layered inorganic compound, wherein the layered inorganic compound comprises a synthetic smectite expressed by the following general formula 1:

$$Na_{0.1-1.0}Mg_{2.4-2.9}Li_{0.1-0.6}Si_{3.5-4.5}O_{9.5-10.5}(X)_{1.5-2.5} \quad \text{General formula 1}$$

wherein X denotes at least one selected from OH and F, and wherein the synthetic smectite is obtained by a process comprising reacting a mixed solution of silicic acid and magnesium salt with an alkaline solution to synthesize a silicon-magnesium complex, removing electrolyte which is a by-product of the reaction, adding lithium ions together with at least one selected from sodium ions and fluorine ions to the silicone-magnesium complex so as to subject the mixture to a hydrothermal reaction.

13. The toner according to claim 12, wherein the toner is obtained by a process comprising dissolving or dispersing a toner material comprising an active hydrogen group containing compound, a polymer reactive with the active hydrogen group containing group, a binder resin and the filler in an organic solvent so as to prepare a toner solution, emulsifying or dispersing the toner solution in an aqueous medium so as to prepare an emulsified dispersion, reacting the active hydrogen group containing compound and the polymer reactive with the active hydrogen group containing compound in the aqueous medium so as to generate an adhesive base in the shape of particles, and removing the organic solvent.

14. A developer comprising:

a carrier; and the toner of claim 12.

15. An image forming method, comprising:

forming a latent electrostatic image on a latent electrostatic image bearing member;

developing the latent electrostatic image using the toner of claim 12 so as to form a visible image;

transferring the visible image onto a recording medium; and fixing the transferred image on the recording medium.

* * * * *